US008413732B2

(12) United States Patent
Richardson et al.

(10) Patent No.: US 8,413,732 B2
(45) Date of Patent: Apr. 9, 2013

(54) SYSTEM AND METHOD FOR SODIUM AZIDE BASED SUPPRESSION OF FIRES

(75) Inventors: Adam T. Richardson, Belleville (CA); George Goetz, Fountain Hills, AZ (US)

(73) Assignee: N2 Towers Inc. (CA)

( * ) Notice: Subject to any disclaimer, the term of this patent is extended or adjusted under 35 U.S.C. 154(b) by 560 days.

(21) Appl. No.: 12/577,011

(22) Filed: Oct. 9, 2009

(65) Prior Publication Data

US 2010/0170684 A1 Jul. 8, 2010

Related U.S. Application Data

(63) Continuation-in-part of application No. 11/878,999, filed on Jul. 30, 2007.

(60) Provisional application No. 60/873,979, filed on Dec. 11, 2006.

(51) Int. Cl.
*A62C 35/00* (2006.01)

(52) U.S. Cl. ..... 169/9; 169/28

(58) Field of Classification Search ..... 169/6, 9, 169/11, 12, 28, 45, 46, 54, 67, 84; 280/740, 280/741, 736; 149/36, 62, 76
See application file for complete search history.

(56) References Cited

U.S. PATENT DOCUMENTS

| | | | | |
|---|---|---|---|---|
| 5,507,890 | A | 4/1996 | Swann et al. | |
| 5,585,597 | A * | 12/1996 | Faigle et al. | 102/530 |
| 5,610,359 | A | 3/1997 | Spector et al. | |
| 5,660,236 | A | 8/1997 | Sears et al. | |
| 5,865,257 | A | 2/1999 | Kozyrev et al. | |
| 6,024,889 | A | 2/2000 | Holland et al. | |
| 6,089,326 | A | 7/2000 | Drakin | |
| 6,116,348 | A | 9/2000 | Drakin | |
| 6,136,114 | A | 10/2000 | Johnson et al. | |
| 6,213,501 | B1 * | 4/2001 | Hock | 280/736 |
| 6,328,906 | B1 * | 12/2001 | Lundstrom et al. | 252/5 |
| 2005/0115721 | A1 | 6/2005 | Blau et al. | |
| 2005/0150665 | A1 * | 7/2005 | Wierenga et al. | 169/85 |
| 2007/0007019 | A1 * | 1/2007 | Wierenga et al. | 169/30 |
| 2008/0135266 | A1 | 6/2008 | Richardson et al. | |

FOREIGN PATENT DOCUMENTS

| | | | |
|---|---|---|---|
| DE | 19546528 | A1 | 6/1997 |
| DE | 19717044 | A1 | 10/1997 |
| EP | 0 672 563 | A1 | 9/1995 |
| WO | 93/15793 | A1 | 8/1993 |
| WO | 94/19060 | A1 | 9/1994 |
| WO | 03/024534 | A1 | 3/2003 |

OTHER PUBLICATIONS

Jul. 13, 2011 Office Action for U.S. Appl. No. 11/878,999 and Notice of References Cited.

(Continued)

*Primary Examiner* — Davis Hwu
(74) *Attorney, Agent, or Firm* — Katten Muchin Rosenman LLP

(57) ABSTRACT

A fire suppressing gas generator includes a cylindrical housing comprising an array of discharge ports distributed generally uniformly therearound; a cylindrical filter disposed within the housing and spaced from the interior wall of the housing; a plurality of azide-based propellant grains inside the cylindrical filter; and at least one ignition device associated with the propellant grains. The propellant grains when ignited by the ignition device generate a fire suppressing gas which passes through the filter and out of the discharge ports of the cylindrical housing for delivery into a space.

25 Claims, 23 Drawing Sheets

OTHER PUBLICATIONS

Yang, J. et al., "Solid Propellant Gas Generators: An overview and their application to fire suppression ", International Conference on Fire Research and Engineering, Orlando, Florida, Sep. 10-15, 1995.

Transmittal; International Search Report; and the Written Opinion of the international Searching Authority for International Application No. PCT/CA2010/001287, mailed Nov. 19, 2010.

"Pyrogen Simply Better Than Halon" Announcement Pyrogen, XX, XX, 1998, p. Complete05 XP000669776.

Fletcher M: "Fighting Fire With Fire" Eureka (Inc. Engineering Materials and Design), Findlay Publications, Horton Kirby, Kent, GB, vol. 20, No. 1, Jan. 2000, p. 17 XP000877927 ISSN: 0261-2097.

* cited by examiner

FIG.1A.
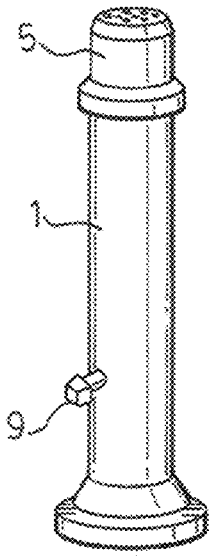
FIG.1B.
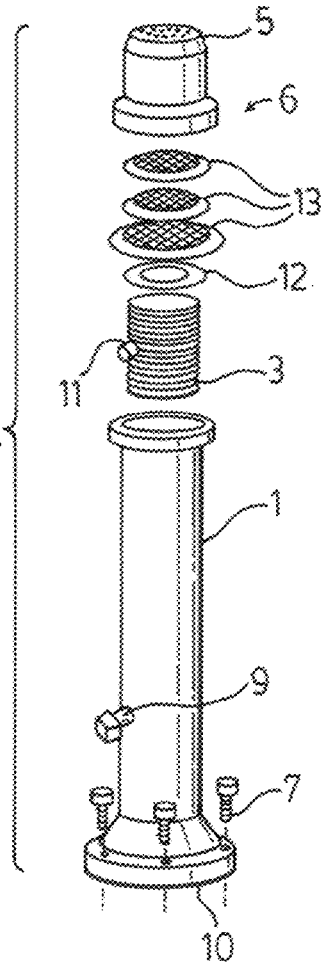
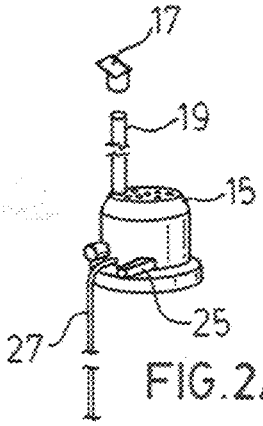
FIG.2A.
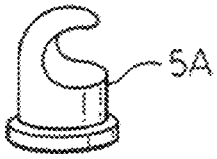
FIG.2B.
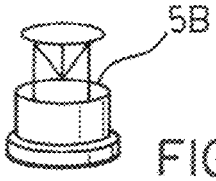
FIG.2C.
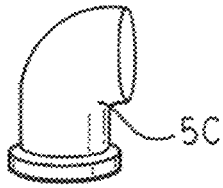
FIG.2D.

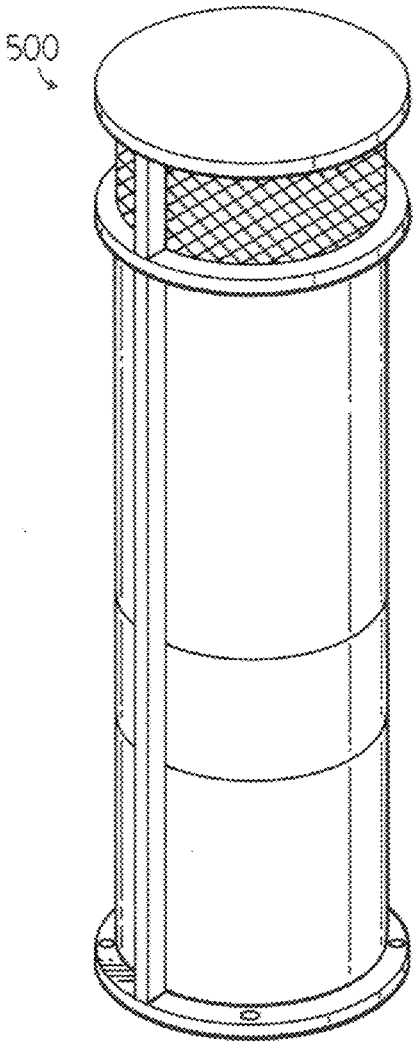
FIG. 8.
FIG. 9.
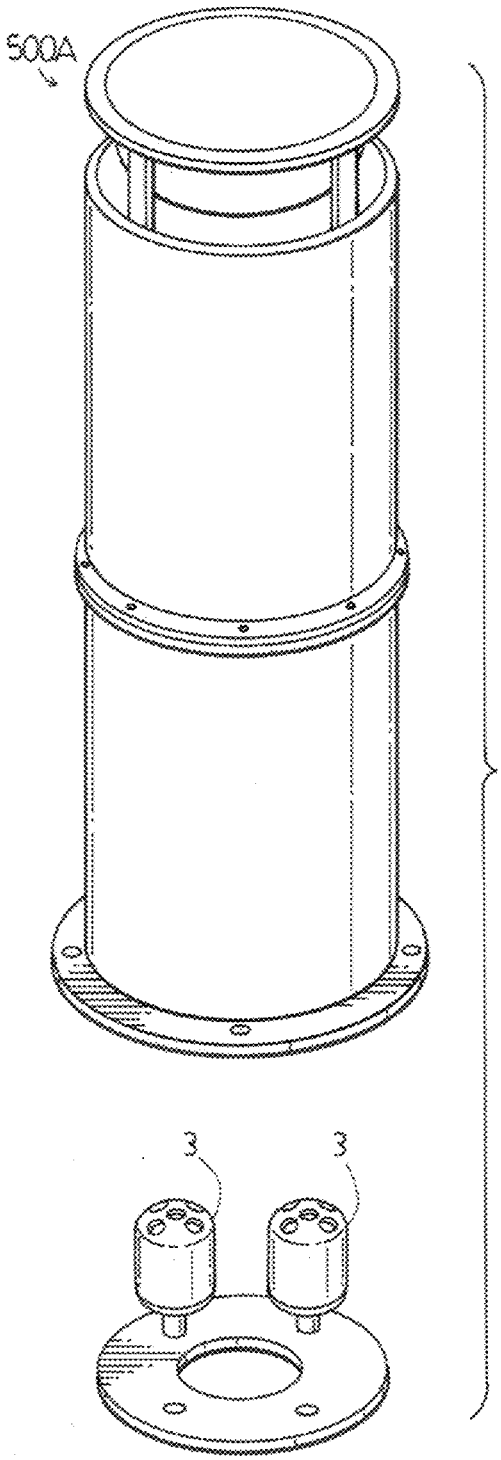

SYSTEM AND METHOD FOR SODIUM AZIDE BASED SUPPRESSION OF FIRES

CROSS REFERENCE TO RELATED APPLICATIONS

This application is a continuation-in-part of U.S. patent application Ser. No. 11/878,999 filed on Jul. 30, 2007, which claims priority under 35 U.S.C. 119(e) from U.S. Provisional Patent Application No. 60/873,979 filed Dec. 11, 2006.

FIELD OF THE INVENTION

The present invention is directed to a system and method for suppressing fires in normally occupied areas, and more particularly to a system and method for sodium azide based suppression of fires.

BACKGROUND OF THE INVENTION

Numerous systems and methods for extinguishing fires in a building have been developed. Historically, the most common method of fire suppression has been the use of sprinkler systems to spray water into a building for cooling the fire and wetting additional fuel that the fire requires to propagate. One problem with this approach is the damage that is caused by the water to the contents of the occupied space.

The "total flood" clean agent fire protection system industry provides high value asset protection for spaces, such as computer rooms, telecommunications facilities, museums, record storage areas, and those housing power generation equipment. "Total flood" protection in such applications is provided by automatically filling the protected compartment completely at a uniform concentration that assures that the fire will be extinguished, no matter where it might be located. The extinguishing medium used in such systems is expected to be "clean"—that is, leave no or very little residue behind after discharge that must be cleaned up.

Known total flood fire protection systems typically comprise a bank of several (commonly tens or more) thick-walled metal bottles for holding an extinguishant (either liquefied or in the gaseous state) at high pressure to permit high-density storage. The extinguishant is released via either manual or automatic activation of high-strength, special purpose valves on the bottles. In order to transmit an extinguishant at masses required to meet precise extinguishing concentrations within a tight tolerance band of room concentration required to meet both the extinguishing and inhalation toxicity requirements, a complex plumbing network designed for the space is required. Furthermore, independent capacities required for individual rooms in a typical multi-room protection scenario (such as a factory or high-rise building) using the same distribution network must be accounted for. Such design and corresponding installation work, including development of flow calculation methodologies for complex flow considerations, requires considerable up-front effort and expense.

High-pressure bottles require frequent inspection due to their propensity for leaks. Once a leak is identified, the leaking bottle may need to be sent to a central re-filling installation, resulting in protection down time at the customer site. Such down time can also be experienced in the event of a man-made or natural disaster, such as a gas leak explosion, tornado or earthquake, which can also damage the piping network itself.

The fluorocarbon known as Halon 1301 has been used in "total flood" systems because it is clean, somewhat non-toxic and highly efficient. Due to their use of ozone depleting greenhouse gases, however, systems employing Halon 1301 are being replaced by more environmentally friendly alternative systems, as mandated by the 1987 Montreal and 1997 Kyoto International Protocols. One example of a Halon 1301 alternative system uses the hydroflourocarbon HFC-227ea (e.g. Marketed as "FM-200" or "FE-227" in Fire Suppression Systems such as those manufactured by Kidde Fire Systems).

Such "first generation" Halon alternatives, including "clean" hydrofluorocarbons behave in a similar manner to Halon 1301, but have been found not to be as effective in comparison since they typically do not have the flame chemistry inhibition of Halon 1301. As a result, fire suppression systems using Halon replacements require from two to ten times the extinguishant mass and storage space, and are therefore more costly. Furthermore, the increased storage space required for the large increase in number of extinguishant bottles poses a difficult placement problem for facility engineers, and a considerable obstacle for those wishing to retrofit an existing Halon installation with a bottle "farm" many times bigger than its Halon predecessor in a limited storage space.

Most of these Halon alternative hydrofluorocarbons have human exposure toxicity limits very close to their required extinguishing design concentrations. They are therefore more sensitive to changes in room storage filling capacity in terms of occupant risk. Such exposure times are typically limited to five minute or less providing occupants with reduced evacuation capability. Occupants who are injured, aged, disabled and may also be medical patients may find this evacuation time challenging, and the increased cardio toxicity risk with many of these Halon alternative extinguishants makes limited exposure scenarios even more critical.

Once discharged into a room, known Halon alternatives of this type are hydrofluorocarbons having a propensity to decompose into large quantities of hydrogen fluoride, after exposure to an open flame. Hydrogen fluoride is an acid that can pose significant health hazards to occupants and rescue personnel, and can damage equipment. For this reason, at least the U.S. Navy has used water mist to wash out hydrofluoric acid after hydrofluorocarbon ("HFC") discharge in a machinery space fire, in addition to cooling the compartments, to protect firefighter personnel. Furthermore, HFC chemicals have been determined to have long atmospheric lifetimes, thereby making them subject to subsequent global warming legislation worldwide in line with the Kyoto Protocol Treaty and proposed November 2009 changes to the Montreal Protocol Treaty. Also, the California Environmental Protection Agency's, Assembly Bill 32, the global warming solutions act of 2006, bans the eventual use of HFC's in fire systems.

"Environmentally friendly" alternatives to the hydrofluorocarbons have been proposed and even fielded to a limited degree, but many also suffer from their own design and operational limitations. Water mist systems were devised to use less water than sprinkler systems, and hence cause less water-related damage, although such damage is only reduced, not eliminated. Even with considerable research and engineering expertise applied internationally, it has proven very difficult to design mist delivery systems for fire suppression around obstacles that are as effective as gases. The efficiency of suppression is largely influenced by the size and nature of the fire. Inert gas systems, such as those using nitrogen or argon, require up to ten times the number of bottles of their Halon predecessor (due to their inefficiency and inability to be liquefied under pressure in a practical manner). Such requires not only considerable additional storage space, but often larger diameter plumbing that would need to replace Halon-suitable pipes. The very high pressure bottles used in inert gas systems can also pose an additional safety hazard if damaged or otherwise compromised, including the thicker-walled distribution plumbing that might be vulnerable at any joint connections.

Another method for fire suppression involves dispersal of gases such as nitrogen, in order to displace oxygen in an enclosed space and thereby terminate a fire while still rendering the enclosed space safe for human occupancy for a period of time. For example, U.S. Pat. No. 4,601,344, issued to The Secretary of the Navy, discloses a method of using a glycidyl azide polymer composition and a high nitrogen solid additive to generate nitrogen gas for use in suppressing fires. This patent envisions delivery of a generated gas to a fire via pipes and ducts, and does not disclose any particular means by which to package the solid additive. Furthermore, the patent does not consider the challenges in distributing an appropriate quantity of generated nitrogen gas into a habitable space and does not to consider concentrations that would reliably extinguish fires, while permitting the safe occupancy and exposure to humans for a time.

According to the requirements for inert gas generator fire suppression systems inside a normally occupied space set by the National Fire Protection Association (NFPA) such as NFPA Standard 2001, the US United States Environment Protection Agency (EPA) such as the SNAP List, and UL/FM/ULC Listings & Approvals, a space must be able to be occupied for up to five (5) minutes. Furthermore, inert gases must be reduced to a maximum of 75 degrees Celsius or 167 degrees Fahrenheit at the generator's discharge port.

U.S. Pat. Nos. 6,016,874 and 6,257,341 (Bennett) disclose the use of a dischargeable container having self-contained therein an inert gas composition. A discharge valve controls the flow of the gas composition from the closed container into a conduit. A solid propellant is ignited by an electric squib and burns thereby generating nitrogen gas. This patent envisions delivery of a generated gas via a conduit into a space.

U.S. Pat. No. 7,028,782 (Richardson) and U.S. Patent Application Publication No. 2005/0189123 (Richardson et al.) disclose means of exploiting gas generator technology by use of non-azide propellants in a stand-alone system featuring multiple individual gas generator cartridges in a given container. Some non-azide materials produce water vapor, however, which can condense onto the walls and other surfaces of the compartment to be protected. Some end users prefer protection schemes that pose little or no possibility of any such water condensation that might harm paper records or other moisture-sensitive contents. Furthermore, the extinguishant from non-azide materials is typically extremely hot, and therefore must be cooled significantly for use in normally occupied spaces. Cooling is achieved with the use of a large mass of cooling bed material also stored in proximity to the multi-cartridge container. The large mass takes up space that could be filled with additional generators, thereby reducing the overall protection space efficiency of a given cartridge container.

Although systems exist for total flood fire suppression applications, improvements are of course desirable. It is an object of the present invention to provide a device and method for delivering a fire suppressing gas into a space.

SUMMARY OF THE INVENTION

According to an aspect, there is provided a device for delivering a fire suppressing gas to a space, comprising:

a housing disposed within the space;

at least one generator disposed within the housing and containing pre-packed sodium azide propellant;

an ignition device for igniting said sodium azide propellant and thereby generating a low-moisture fire suppressing gas; and an opening in the housing for directing the fire suppressing gas mixture into said space.

According to another aspect, there is provided an apparatus for suppressing fires in a space comprising:

a sensor for detecting a fire;

at least one solid sodium azide based inert gas generator for generating and delivering a fire suppressing, substantially dry nitrogen gas mixture to the space upon receiving a signal from the sensor; and an inert gas discharge diffuser to direct the fire suppressing gas mixture into said space.

According to another aspect, there is provided a method of suppressing fires in a space comprising:

generating a first fire suppressing gas mixture from at least one sodium azide based propellant chemical, the first fire suppressing gas mixture comprising primarily nitrogen, filtering at least one of moisture, additional gases and solid particulates from the first fire suppressing gas mixture to produce a second fire suppressing gas mixture; and delivering the second fire suppressing gas mixture into the space.

According to another aspect, there is provided an apparatus for suppressing fires in a normally occupied and or un-occupied space comprising:

a sensor for detecting a fire;

at least one solid sodium azide based inert gas generator for generating and delivering a fire suppressing, substantially dry gas mixture including nitrogen to the space upon receiving a signal from the sensor; and an inert gas discharge diffuser to direct the fire suppressing gas mixture into said space.

According to another aspect, there is provided a gas generator for generating and delivering a substantially dry fire suppressing gas mixture to a space, comprising:

a housing;

at least one pre-packed sodium azide propellant disposed within said housing;

a pyrotechnic device for igniting said sodium azide propellant and thereby generating said fire suppressing gas mixture; and a discharge diffuser for directing the fire suppressing gas mixture within said enclosed space.

Previously, sodium azide based propellants were generally thought to be unsuitable for normally occupied spaces. Further research has revealed that sodium azide based propellants can now be provided which are indeed suitable for normally occupied spaces.

A sodium azide based propellant is preferable in many applications due to its ready availability and affordability, and its characteristic of producing nearly-pure nitrogen gas as its gaseous post-combustion by-product. The sodium azide may be mixed with other minor ingredients which serve as propellant binders or provide other operational performance enhancements, as is commonly known to those skilled in the art.

Advantageously, propellants generated by sodium azide based materials are typically 10% to 15% of the temperature those generated by non-azide based propellants. For example, it is typical for sodium azide propellants to burn at about 1500 degrees Fahrenheit for discharged at approximately 400 degrees Fahrenheit with use of a heat sink and non-azide propellants to burn at the 3,000 degrees Fahrenheit range. Thus, sodium azide based propellants require approximately only 10% to 15% of the bulk heat sink required for such non-azide based propellants. Use of sodium azide based materials therefore permits a significant reduction in size, or the inclusion of more propellant generators in a given volume.

In one embodiment, multiple, uniformly-sized solid propellant gas generator cartridges are incorporated into a single "tower" design installed in the space to be protected without piping or ducts. This design eliminates the need for remote bottle installation and a network of distribution plumbing that would otherwise be required.

Each tower may be configured to protect a given number of cubic feet of free compartment volume. For example, multiple towers with several cartridges may be used for large areas, while fractional volume coverage can be achieved by simply reducing the number of cartridges in a given tower.

These normally non-pressurized towers, when activated either manually or by use of a conventional fire alarm panel, in turn activate propellant generation by multiple generator cartridges in a tower, sequencing each of them in order after each cartridge has completed its individual discharge, or discharging all simultaneously as desired or required by the application.

Even though the cartridges can have a shelf life of many years if stored away from high moisture areas (possibly up to twenty), their replacement is made simple by simple removal and re-insertions of "fresh" cartridges, which can be performed by personnel on site without the need to ship units for refurbishment, nor requiring personnel with special training and tools for high-pressure equipment. This dramatically reduces cost of ownership.

The simplicity of the installation and maintenance approach provides opportunities for distributors that do not currently have deployed teams of pressurized equipment-experienced field personnel to offer products to their customers using their current personnel support infrastructure.

The solid gas propellant is housed within a tower system positioned within a space to be protected, and therefore requires no piping. This represents a dramatic reduction in cost and also results in minimal asset protection "down time" during replacement of existing Halon 1301 systems.

The towers of the present invention do not have to be removed from the location they are protecting in order to be recharged. Rather, the inventive system may be recharged on site through the use of pre-packed sodium azide-based propellant generators. The system is preferably operated to permit human life to be maintained for a period of time (e.g. by maintaining a sufficient mix of gases in the building to permit human habitation for a period of time while still being useful for suppressing fires).

According to an alternative embodiment, the gas generator units are suspended from the ceiling, or actually mounted on the ceiling or suspended above a drop ceiling and or in a raised floor space commonly used as electrical supply "race ways" inside computer, server net, programmable controller rooms, etc., utilized around the world. Such mounting locations can be selected to not impede personnel operations or occupation of usable space within the room. Protection units may be a single unit sized for the compartment volume to be protected or an assemblage of smaller individual cartridges mounted within a fixture, with sufficient cartridges added to protect a given protected volume. These singular and or multiple gas generators mounted in occupied or unoccupied spaces can have an external heat sink module added to each generator if required.

In one embodiment, a bracket is mounted in a sub-floor of, for example, a computer room and supports multiple generators.

The suppressing gas mixture permits the space to be habitable by human life for a predetermined time. Preferably, the predetermined time ranges from about one to five minutes, as per the requirements of the National Fire Protection Association's 2001 standard for clean agent Halon 1301 alternatives and the US EPA SNAP Listings for fire suppression use in occupied spaces.

In one embodiment, the apparatus further comprises at least one filter and screen for filtering any solid particulates and reducing the heat of the gas generated prior to the delivery of the fire suppressing gas to the normally occupied and or un-occupied space.

According to an aspect, there is provided a fire suppressing gas generator comprising:

a cylindrical housing comprising an array of discharge ports distributed generally uniformly therearound;

a cylindrical filter disposed within the housing and spaced from the interior wall of the housing;

a plurality of azide-based propellant grains inside the cylindrical filter; and at least one ignition device associated with the propellant grains;

wherein the propellant grains when ignited by the ignition device generate a fire suppressing gas which passes through the filter and out of the discharge ports of the cylindrical housing for delivery into a space.

According to another aspect, there is provided a method of suppressing fires in a space, comprising:

providing a container containing a solid propellant chemical that when ignited produces a fire suppressing gas, the container having at least one discharge port;

delivering the fire suppressing gas into the space including directing the fire suppressing gas from the at least one discharge port generally tangentially along a surface of an object in the space thereby to encourage vorticity of the fire suppressing gas within the space.

According to still another aspect, there is provided a fire suppressing system comprising:

a tower comprising a frame;

a plurality of fire suppressing gas generators disposed within the frame, each fire suppressing gas generator comprising:

a cylindrical housing comprising an array of discharge ports distributed generally uniformly therearound;

a cylindrical filter disposed within the housing and spaced from the interior wall of the housing;

a plurality of azide-based propellant grains inside the cylindrical filter; and at least one ignition device associated with the propellant grains;

wherein the fire suppression system further comprises:

an ignition controller electrically connected to the ignition devices for causing ignition of the ignition devices, wherein the propellant grains when ignited by a respective ignition device generate a fire suppressing gas which passes through the respective filter and out of the discharge ports of the cylindrical housing for delivery into the space.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Embodiments will now be described more fully with reference to the accompanying drawings, in which:

FIG. 1A shows an assembled gas generator fire suppression tower according to the preferred embodiment;

FIG. 1B is an exploded view of the fire suppression tower of FIG. 1A;

FIG. 2A shows electrical connections to a diffuser cap of the tower in FIGS. 1A and 1B;

FIGS. 2B-2D show alternative embodiments of diffuser caps for use with the gas generator fire suppression tower of FIGS. 1A and 1B;

FIG. 8 is an alternative embodiment of a tower;

FIG. 9 is another alternative embodiment of a tower, with a bracket for securing multiple propellant cartridges there within;

DETAILED DESCRIPTION OF THE EMBODIMENTS

Figure 3:
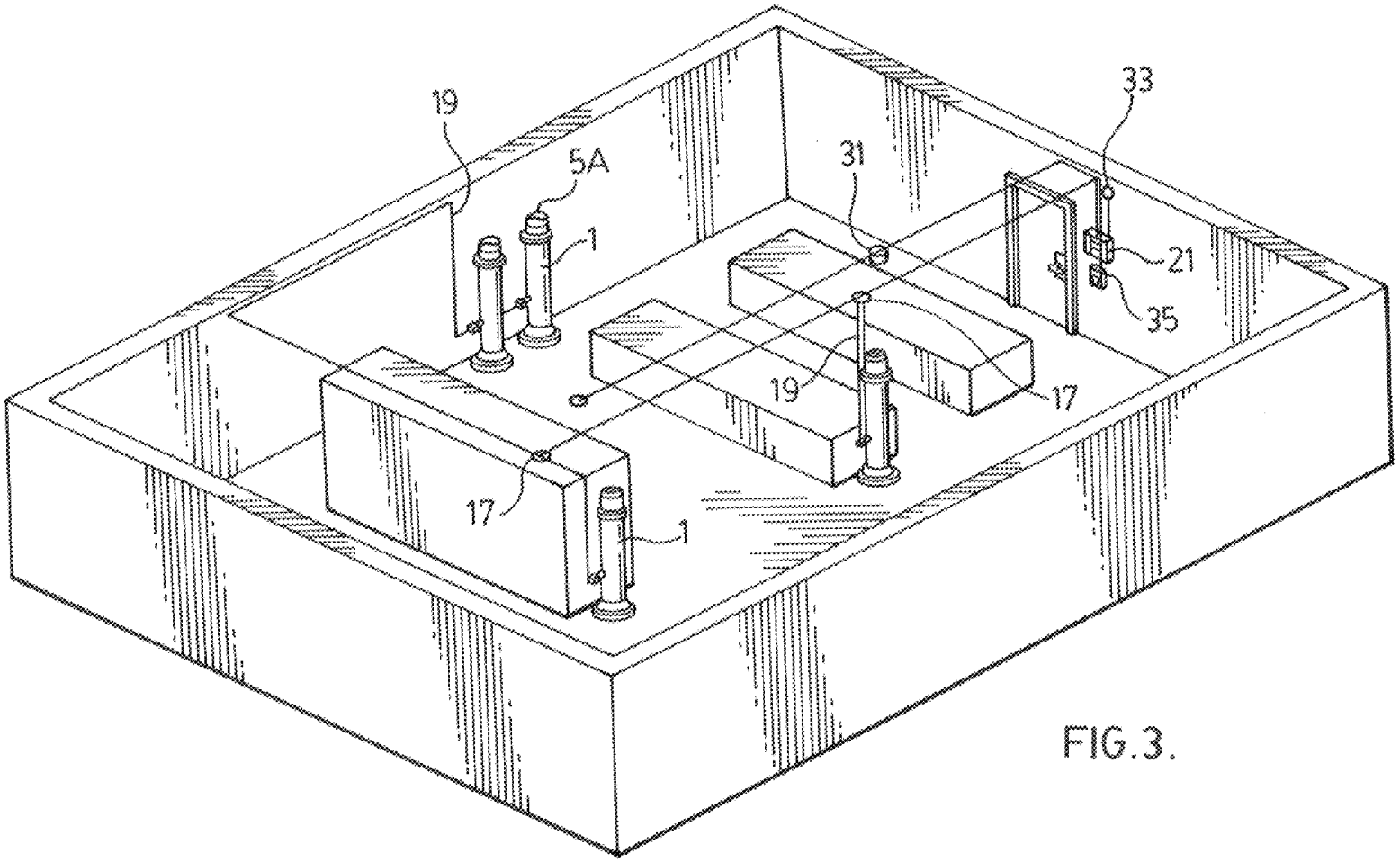
FIG. 3 is a schematic view of an enclosed space protected using the gas generator fire suppression towers of the present invention.

A pre-packed solid gas generator for generating a gas mixture from a sodium azide-based chemical that is suitable for suppressing a fire is provided.

According to the preferred embodiment, a solid chemical mixture is provided that is predominantly sodium azide (about 80.3 percent by weight) and sulphur (19.7 percent by weight), as is disclosed in U.S. Pat. No. 3,741,585. Such mixture can generate approximately 60 pounds of nitrogen gas per cubic foot of solid propellant blend. It will be understood that other azide-based blends exist in the current art that satisfy this requirement.

As shown in FIGS. 1A and 1B, a gas generator fire suppression tower 1 is provided containing a pre-packed sodium azide-based solid propellant canister 3 and a discharge diffuser 5 for discharging generated gases. The tower 1 is secured in position by floor mounting bolts 7 passing through a mounting flange 10, or any other suitable means. The diffuser 5 is likewise secured to the tower 1 using flange bolts with nuts 6.

A pyrotechnic device 9 (i.e. a squib) is attached to the pre-packed sodium azide propellant canister 3 by way of a connector 11, and to a fire detection and release control panel discussed in greater detail with reference to FIGS. 2A and 3. The squib is used to initiate the inert gas generation in response to electrical activation.

A propellant retainer 12 may be provided along with various optional filters and/or heat sink screens 13, as discussed in greater detail below.

Turning to FIG. 2A in combination with FIG. 3, the discharge diffuser 5 is shown having a perforated cap 15. A raceway ceiling mounting foot 17 is provided for securing a conduit/wiring raceway 19 (e.g. steel pipe) between the fire detection and release panel 21 (FIG. 3) and a conduit connection 23 on a bracket 25. The conduit continues downwardly to the squib 9, as shown at 27.

FIGS. 2B-2D show alternative embodiments of discharge diffusers 5, for different installations of the tower 1, which may serve either as replacements for the perforated cap diffuser or be placed there over. More particularly, FIG. 2B depicts a 180° directional diffuser cap 5A useful for installations wherein the tower is disposed along a wall. FIG. 2C depicts a 360° directional diffuser cap 5B useful for installations wherein the tower is centrally disposed. FIG. 2D depicts a 90° directional diffuser cap 5C useful for installations wherein the tower is disposed in a corner.

With reference to FIG. 3, a system is shown according to the present invention for suppressing fires in a space using a plurality of towers 1 as set forth in FIGS. 1 and 2. In operation, a sensor 31, upon detecting a fire, issues a signal to the control panel 21 which, in response, activates an alarm signaling device 33 (e.g. audible and/or visual alarm). Alternatively, an alarm may be initiated by activating a manual pull station 35. In response, the control panel 21 initiates a solid gas generator by igniting the pyrotechnic device 9, which in turn ignites the sodium azide chemicals in the pre-packed canister 3 that produce the fire suppressing gas. The fire suppressing gas mixture comprises primarily nitrogen.

The fire suppressing gas mixture may contain trace amounts of carbon dioxide and water vapor, which are optionally filtered using filters 13 (FIG. 1), resulting in the production of a filtered, dry fire suppressing gas mixture, thereby not resulting in any water condensation inside the protected area. More particularly, the fire suppressing gas mixture may be filtered so that the gas introduced into the room (FIG. 3)

contains from about zero to about five wt % carbon dioxide and preferably, from about zero to about three wt % carbon dioxide. More preferably, substantially all of the carbon dioxide in the mixture is filtered out of the mixture.

Heat sink screens may be used to reduce the temperature of the fire suppressing gas generated as a result of igniting the pre-packed sodium azide based propellant canister 3. Although the filters and screen(s) 13 are shown as being separate from the pre-packed canister 3, it is contemplated that at least the screen(s) may be incorporated as part of the canister structure. This is possible particularly due to the use of sodium azide based propellant generate, since as stated above the amount of heat sinking required is typically far less than that required of non-azide based generates.

Since there is no requirement to use compressed gas cylinders, discharge piping and discharge nozzles for the supply or transport of an extinguishing gas mixture, the system of FIG. 3 enjoys several advantages over the known prior art. Firstly, the use of solid gas generators allows large amounts of gases to be generated with relatively low storage requirements. This reduces the cost of the system, making it more attractive to retrofit existing Halon 1301 systems with environmentally acceptable alternatives (i.e. inert or near-inert gasses are characterized as being zero ozone depleting and have zero or near-zero global warming potential).

Secondly, the system benefits from simplified installation and control since all of the solid gas generators need not be provided at one central location. Instead, one or more solid gas generators or towers 1 are preferably positioned at the location where the fire will have to be suppressed. In this way, the generation of fire suppressing gases within the hazard area, substantially simplifies the delivery of the gases without the need of a piping system extending throughout a building or perhaps through one or two walls.

Thirdly, the provision of independently positioned towers 1 results in the gas being generated and delivered to the hazard area almost instantaneously as it is released. This increases the response time of the fire suppressing system and its ability to inert the hazard area and suppress the fire in a normally occupied and or un-occupied space. Each solid gas generator 1 is preferably designed to generate a quantity of gas needed to extinguish a fire within a specific volume divided by the actual total volume of space being protected by any one sodium azide based pre-packed propellant generator fire suppression system, should the need arise.

The potentially filtered fire suppressing gas mixture is delivered into the room (FIG. 3) containing a fire. The volume of filtered fire suppressing gas to be delivered into the room depends on the size of the room. Preferably, enough of the filtered fire suppressing gas mixture is delivered into the room to suppress any fire in the room, yet still permit the room to be habitable by human life for a predetermined time. More preferably, a volume of filtered fire suppressing gas mixture is delivered into the room that permits the room to be habitable by human life for approximately one to five minutes, and more preferably from three to five minutes, as per the requirements of the National Fire Protection Association's 2001 Standard for Halon 1301 clean agent alternatives and the US EPA SNAP Listing for fire suppression system's use in normally occupied and or un-occupied spaces. The person having ordinary skill in this art knows that the National Fire Protection Association's 2001 standard (published by the NFPA entitled NFPA 2001 Standard on Clean Agent Fire Extinguishing Systems ("NFPA 2001"), states in Section 1-1 of the document:

> 1-1 Scope. This standard contains minimum requirements for total flooding and local application clean agent fire extinguishing systems. It does not cover fire extinguishing systems that use carbon dioxide or water as the primary extinguishing media, which are addressed by other NFPA documents.

According to Subsection 1-5.1.1 of the NFPA 2001 document:

> 1-5.1.1 The fire extinguishing agents addressed in this standard shall be electrically nonconducting and leave no residue upon evaporation.

Furthermore, the definition of clean agent is specified in Section 1-3.8 of the NFPA 2001 document as follows:

> 1-3.8 Clean Agent. Electrically nonconducting, volatile, or gaseous fire extinguishant that does not leave a residue upon evaporation. The word agent as used in this document means clean agent unless otherwise indicated.

Figure 4:
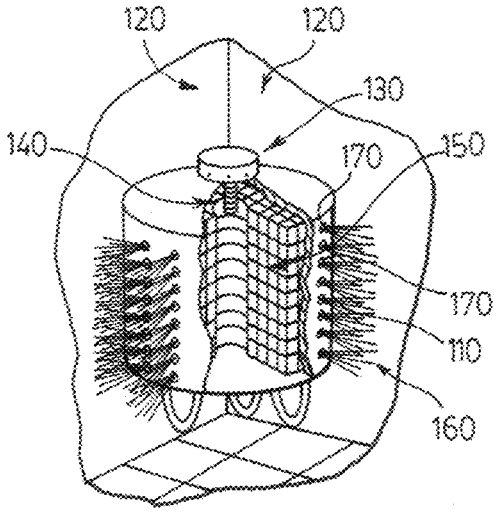
FIG. 4 is an illustration and partial cross section of a single gas generator unit mounted in a corner of a room to be protected, according to an alternative embodiment of the invention.

Referring now to the alternative embodiment of FIG. 4, an illustration and partial cross section is provided of a single gas generator unit mounted in a corner of a room to be protected. In this embodiment, the fire protection unit 110 is a floor mounted unit, in a room 120 to be protected from fire. The unit 110 is located in a space in the room that does not inhibit normal use of the room by occupants, or desired positioning of other equipment. An integral smoke or heat detector 130 is mounted on the unit 110 in this embodiment, although it can also be wired to normal ceiling-mounted smoke detectors. Upon detection of a fire or smoke by the detector 130, it sends an electrical signal to the propellant squib 140 that initiates the burning of the gas generator propellant 150, which generates the inert gas 160 in sufficient quantities to extinguish fires in an occupied compartment, discharged through the orifices or diffuser 170 in the exterior of the unit 110. Such a system, mounted directly into the room to be protected, eliminates the expense of distribution plumbing from a remote storage site, and the expense of its installation. In a variation of this alternative embodiment, the unit 110 can be suspended to hang from the ceiling, or mount directly on the wall, including the use of a wall bracket similar to those used to position televisions in hospital rooms.

Figure 5:
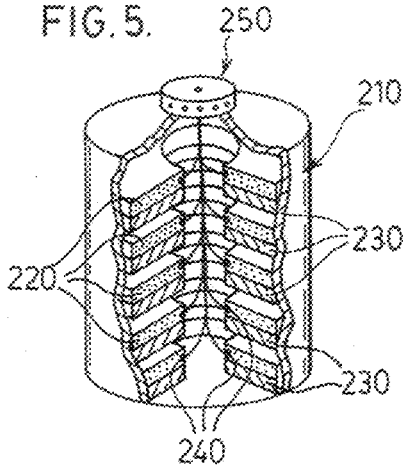
FIG. 5 is an illustration of a variation of the single gas generator room unit of FIG. 4, comprised of multiple gas generator cartridges.

FIG. 5 is an illustration of single gas generator room unit, comprised of multiple gas generator cat Midges. In this variation to the system disclosed in FIG. 4, the unit 210 houses multiple individual gas generator units 220, each sized of a particular capacity to provide a sufficient quantity of inert gas for a given volume of occupied space. An internal rack 230 is a means of selectively installing a variable number of units 220, each with their own squib 240 and wired to the detector 250, to provide a precise quantity of inert gas necessary to protect a given volume of an occupied space to be protected. Although the unit 210 can be sized sufficiently to add a large number of such units to protect a very large space, for very large compartments, multiple units 210 spaced throughout the compartment, may be warranted to provide better mixing and inert gas coverage in the room.

Figure 6:
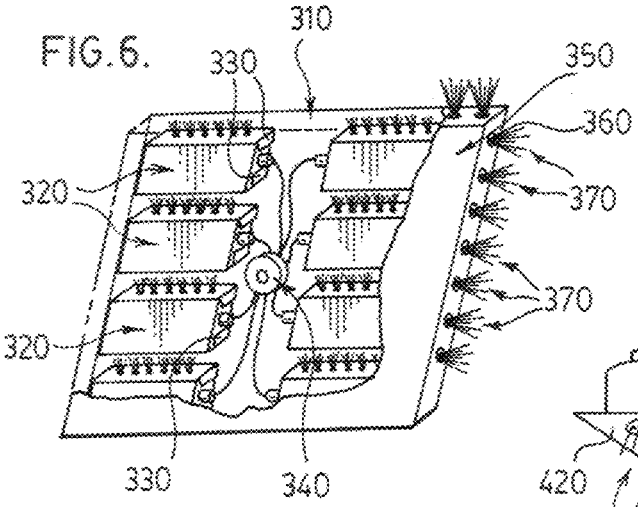
FIG. 6 is an illustration of a ceiling mounted fixture, holding multiple gas generator cartridges, according to a further alternative embodiment of the invention.

FIG. 6 is an illustration of a ceiling mounted fixture, holding multiple gas generator cartridges. A ceiling fixture 310 is mounted on the ceiling, extending a short distance below the ceiling height. Multiple gas generator units 320 can be mounted into the fixture at various bracket locations 330, much like the mounting brackets for individual fluorescent light bulbs. Like the system in FIG. 5, a varied number of units 320 can be added to the fixture 310 to vary the quantity of inert gas produced, and adjust for the room capacity to be protected. The fixture 310 can be sized to hold a certain maximum number of units 320, corresponding to a maximum room volume, or floor space for a given ceiling height, that can be protected with one fixture; beyond this room volume, additional fixtures would be added, spaced evenly throughout the room. As an additional option, the traditional room smoke detector 340 can be mounted into the fixture 310, such as in its center, to activate the units 320 directly within the fixture 310. In this manner, the electrical power wires applied to the detector can also be used to fire the squibs of the units, rather than a remote routing of the power and detector lines, and the expense of routing an additional power line above the ceiling. The fixture 310 is covered with decorative dust cover 350 that hides the units and fixture with an attractive cover that blends into the ceiling motif, and features exhaust holes 360 around its perimeter functioning as a diffuser to direct the inert gas 370 discharged by the units into the room. Such a location and manner of discharge of the system promotes effective mixing with the room air and gives maximum distance for the hot inert gas to cool before coming into contact with occupants below. The location on the ceiling permits the system to require no floor space or room location for mounting, thereby not impeding any activities or usage of the room's floor space.

Figure 7:
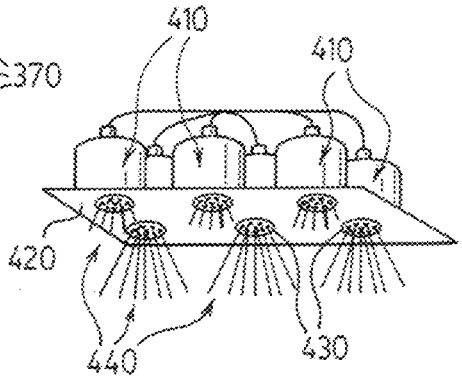
FIG. 7 is an illustration of a ceiling mounted fixture, comprised of multiple recessed gas generator units, according to yet another alternative embodiment of the invention.

FIG. 7 is an illustration of a ceiling mounted fixture, comprised of multiple recessed gas generator units. This unit is virtually identical to the system disclosed in FIG. 6, except this variant exploits the presence of a drop ceiling common to many business and computer rooms, or any other ceiling configuration that permits the mounting of the gas generator units 410 above the ceiling level. The units 410 are mounted to a ceiling cover 420 that are flush with the ceiling, with exhaust holes 430 present in the cover 420 to permit the diffusion and discharge of the inert gas 440 from the gas generator units 410. This configuration has the advantage of having a flush-mounted ceiling unit, without any extension below the ceiling, in an even more discreet design.

Such "in-room" gas generator fire protection systems, with their local detection, power (if supplied with back up power from capacitors or small batteries) and discharge capabilities all present within the compartment, provides a robust protection system that is not impeded by power loss or loss of water pressure, or physical destruction of buildings or structures, or water mains (which would also render water sprinklers unusable) in the event of a catastrophic event at the facility in question, due to earthquakes or other natural disasters, explosions such as due to leaking gas mains, or even terrorist incidents, to continue to provide protection to critical compartments even if the rest of the facility is severely compromised.

An illustration of a particular sizing example will demonstrate the features of the configurations set forth in the alternative embodiments of FIGS. 4-7.

An oxygen concentration of 12% is a desirable target level to provide for occupancy of a space up to 5 minutes during efficient suppression of a fire. Prior testing of prototype gas generator units has shown successful fire extinguishment with units sized approximately 20 gallons in volume, producing 0.535 kg-moles of nitrogen inert gas, discharged into a 1300 cubic foot room, an equivalent volume to be protected by one standard canister of traditional compressed stored inert gas. Such a unit was not optimized in size in any respect, with copious and un-optimized quantities of cooling bed materials used to cool the discharged nitrogen gas.

If such an un-optimized unit were prorated in size, including its oversized cooling bed capacity, it can provide a vastly conservative estimate of sizing on individual units and cartridges necessary when considering current art in gas generator technology and performance. The 0.535 kg-moles of gas can be increased to 0.6884 kg-moles to add the 20% factor of safety required, to result in an acceptable oxygen concentration for the normally occupied space. Sizing for protection for only 100 cubic feet of room space, a total of 1.483 kg of nitrogen is needed, rounded up to 1.5 kg. Using the effective density of the tested unit, even with the un-optimized cooling bed, disc-shaped units of 24 inch diameter, and 1.5 inches thick, or rectangular units 4 inches thick by 9 inches wide and 18 inches long, can produce such quantities. Either unit variant is calculated to weigh 23.4 lbs., if scaling the previously tested 240 lb. unit. Numerous disc shaped units can be stacked for the floor or wall-mounted model; to protect the 1300 cubic feet space associated with a standard compressed inert gas canister, a unit 24 inches in diameter and 19.5 inches tall would be necessary (taking very little space in the room). Such a unit could be increased in room capacity if needed by making it wider or taller (theoretically up to the ceiling height), but it may be alternatively preferred to add additional floor units in a large room. For the ceiling mounted units, the aforementioned rectangular gas generator units could be employed. This would result in an extended fixture distance below the ceiling of the unit of just over 4 inches. The units that recess into the ceiling could be of approximately 10 inches in diameter and 8 inches tall. These individual units can be seen to be of a weight practical for an individual installation technician to lift and install into the overhead ceiling fixture.

If such fixtures are designed to hold up to eight gas generator cartridges per fixture, to protect a ten by ten floor space if an eight foot ceiling is present, then even the total maximum fixture weight of 187 lbs. is practical for mounting to ceiling joists (and less than some ornate lighting fixtures). The individual gas generator units would be designed to discharge their gas along opposite sides along their length through multiple orifices, with such a configuration canceling any thrust loads otherwise possible. Such eight-unit fixtures would only take the ceiling space of about three foot by three foot, including space between the gas generator units for gas to discharge and flow, which is roughly equivalent in area to two common ceiling tiles. The oxygen concentration will only fluctuate in an 800 cubic foot space of less than 1% as one adjusts and adds each additional discrete gas generator unit to adjust for extra room capacity, which is certainly an acceptable tolerance level. In addition, one or two of the additional individual gas generator units can be used under the sub-floor of common computer rooms, to provide required fire protection in those spaces as well. Having a standard size for the cartridges works in favor of reducing the cost in gas generator production, by making many units of one size. If gas generator propellants and units continue to be optimized in the future, individual units as small as 4 inches by 2.5 inches by 5 inches, and a weight of 3.3 lbs. are possible, and full eight-unit ceiling fixtures could fit within a 12 inch square with a four inch thickness, and a weight of 26.5 lbs. fully loaded, if unit efficiencies near 100% are approached.

Figure 10:
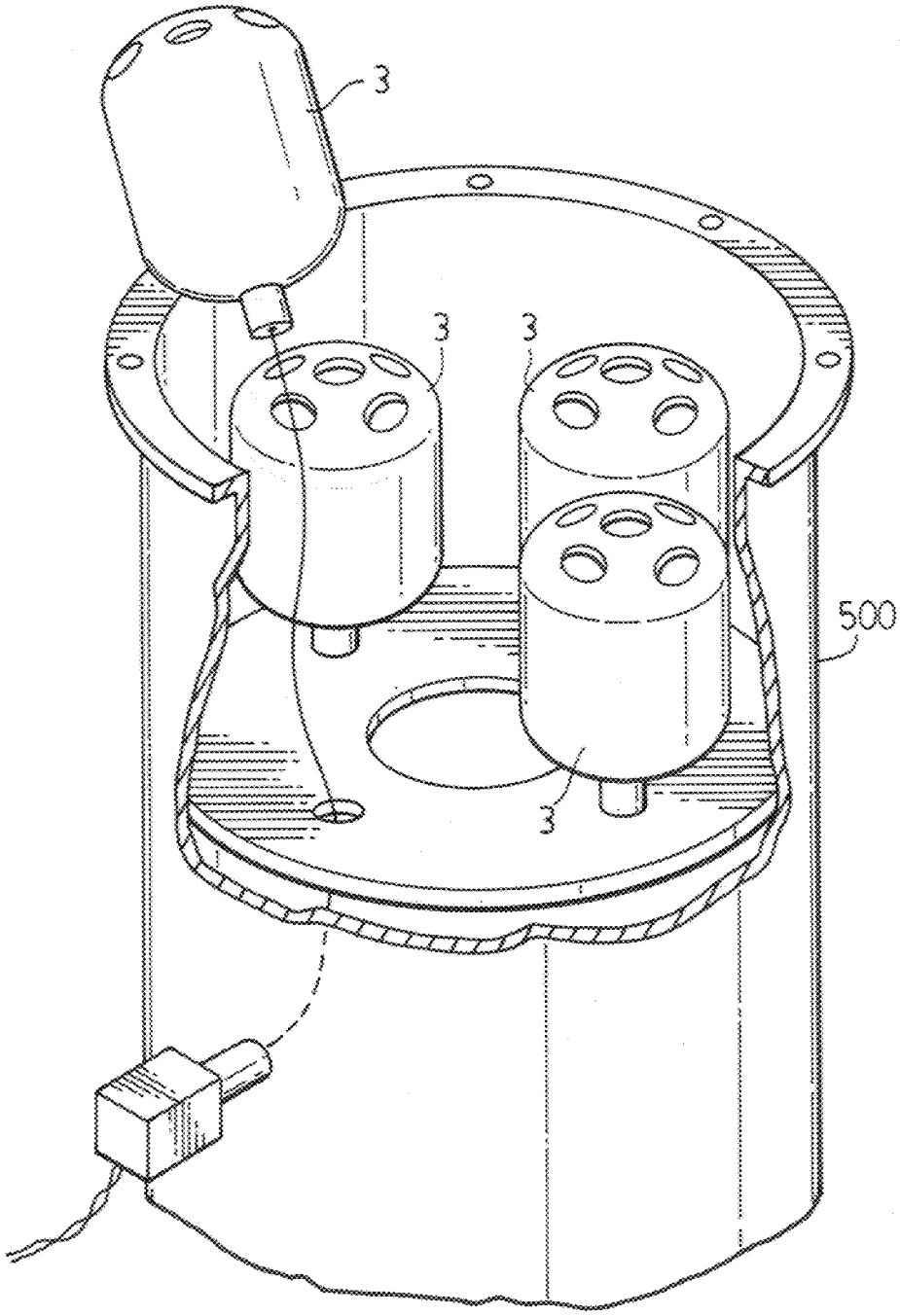
FIG. 10 shows installation of the power harness on a cartridge prior to its connection to the bracket of FIG. 9.
Figure 11:
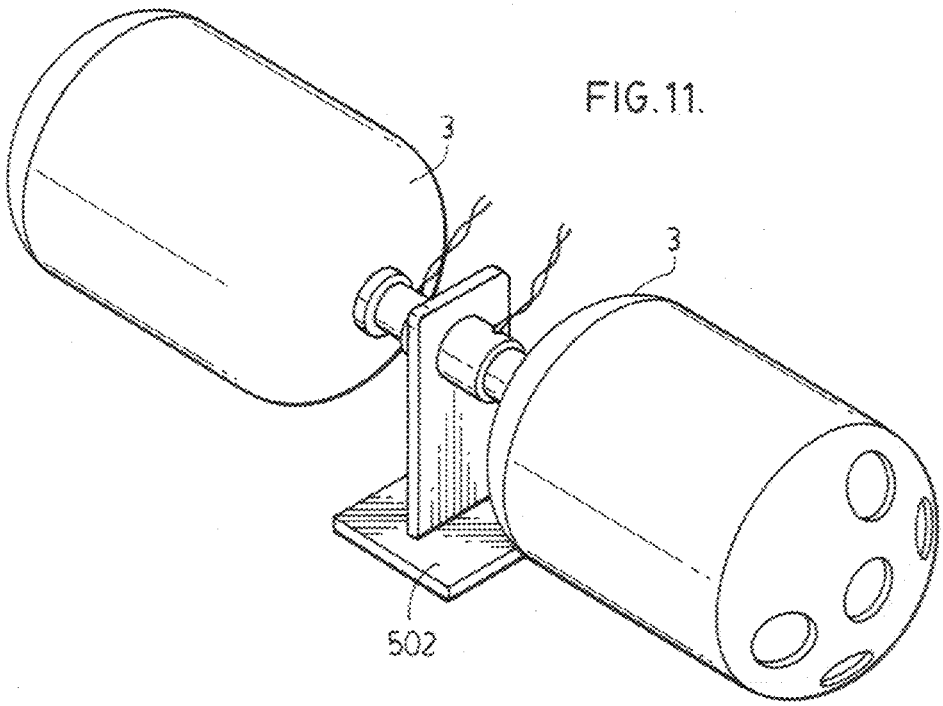
FIG. 11 shows an alternative bracket for securing single or multiple cartridges in a space without a tower.

An illustration of a representative production tower design is shown in FIG. 8, and a photograph of a preliminary tower mockup with generators, is shown in FIG. 9. FIG. 10 is a photograph of a technician installing one of the cartridges in the interior of a tower, and connecting its power harness. FIG. 11 is a photograph of a special assembly designed to mount one or more generator cartridges underneath the sub-floor of a computer room. This configuration does not make use of a tower housing.

Figure 12A:
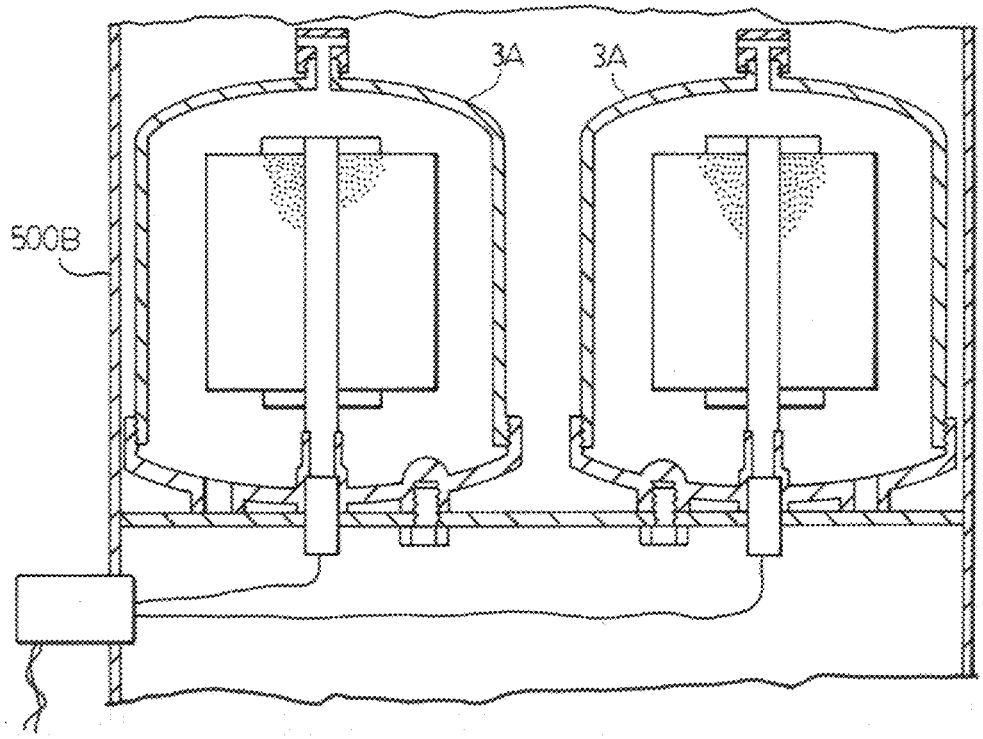
FIG. 12 shows a tower design housing four azide-based nitrogen generating generators.
Figure 12B:
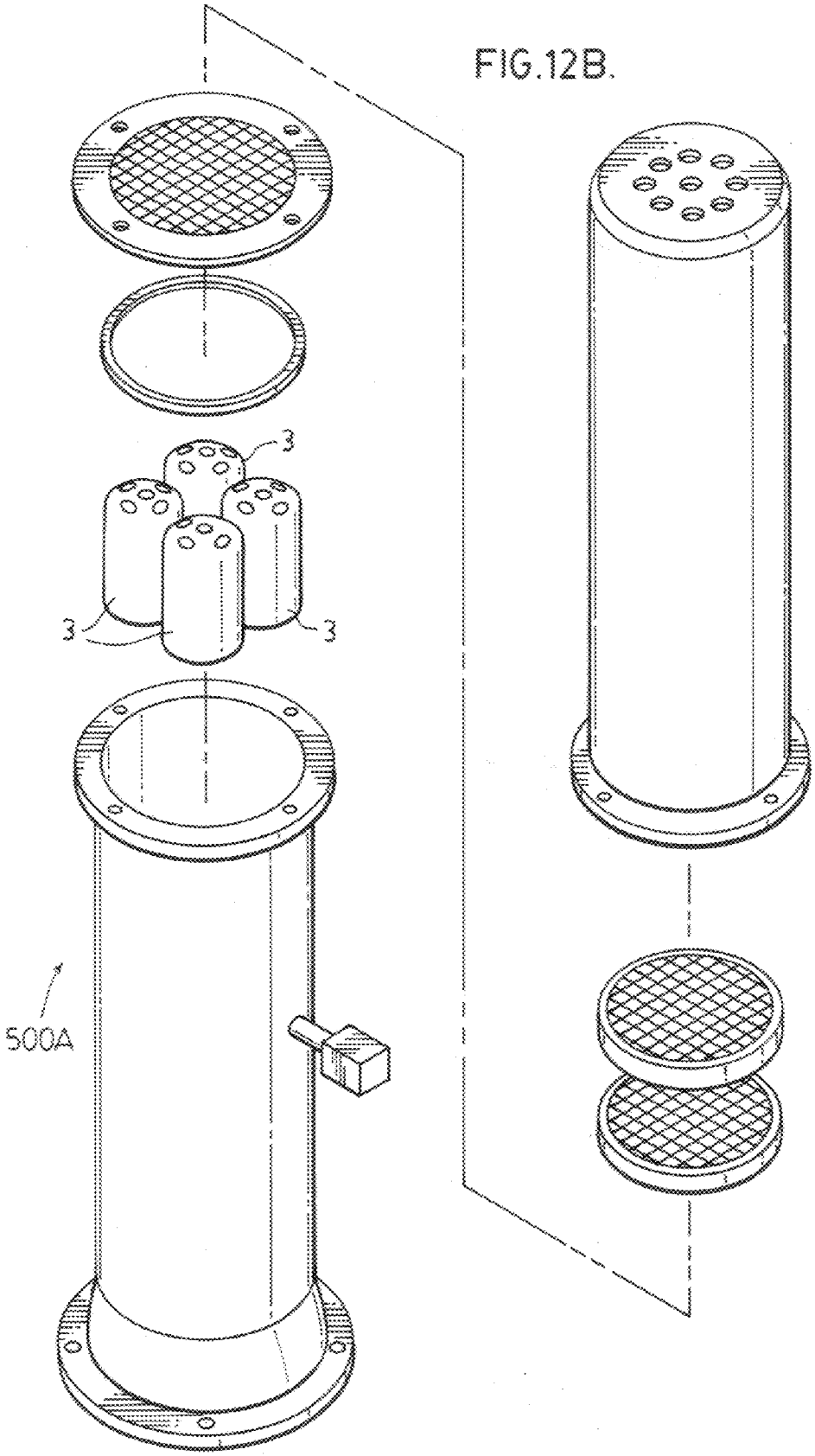

FIG. 12 shows a tower design housing four azide-based nitrogen generating generators, according to an embodiment.

Figure 13:
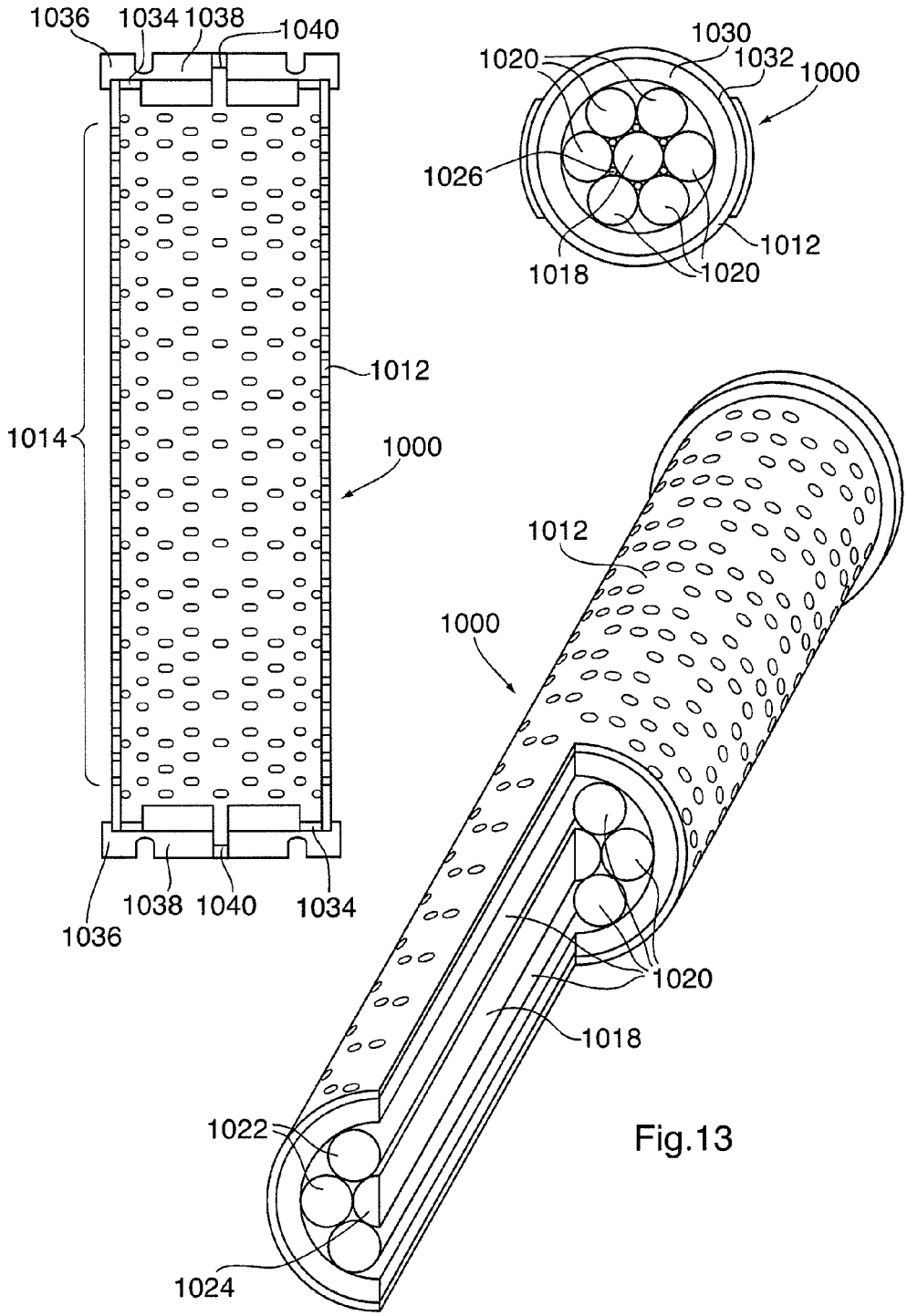
FIG. 13 is a drawing in three views (elevation view, cross-sectional view and perspective partial-cutaway view) of an alternative fire suppression gas generator 1000 and portions thereof.

Alternative configurations having respective advantages are contemplated. For example, FIG. 13 is a drawing in three views (elevation view, cross-sectional view and perspective partial-cutaway view) of an alternative fire suppression gas generator 1000 and portions thereof. In this embodiment, the generator 1000 comprises a housing 1012 formed of a cylindrical steel pipe six (6) inches in diameter and 22.5 inches long. An array of discharge ports 1014 is formed through housing 1012. The discharge ports 1014 in the array are generally uniformly distributed 360 degrees around the cylindrical body of the housing 1012.

A set 1016 of sodium-azide solid propellant grains is disposed inside of housing 1012. In this embodiment, the propellant grain set 1016 comprises a central column 1018 of 36 (thirty-six) propellant grains including 34 (thirty-four) stacked cylinder-shaped "main" propellant grains 1022 capped on each of its ends with 1 (one) "end" grain 1024. Disposed generally in parallel with the central column and therearound are six outer columns 1020 each comprising 36 (thirty-six) stacked cylinder-shaped main propellant grains 1022. Between the central and outer columns of stacked propellant grains are silicone spacers 1026.

As can be seen, the end propellant grains 1024 in the centre column 1018 each have a large bore therethrough sized to receive a portion of an ignition device such as a squib 1150 (not shown in FIG. 13) as will be described, whereas the main grains 1022 do not have as large a bore. The large-bore geometry of end grain 1024 causes faster burning of the end grain 1024 which in turn encourages ignition of the main grains 1022. All grains 1022, 1024 in the set however have a plurality of smaller bores therethrough. The smaller bores through the propellant grains facilitate uniform ignition of each grain 1022, 1024 through improved surface exposure to the heat, and also facilitate the escape of the resultant fire suppressing gas such as nitrogen ($N_2$) from the burning propellant grains 1022, 1024.

Disposed between the set of propellant grains and the housing is a filter pad 1030. In this embodiment the filter pad 1030 comprises an inner coarse-screen steel mesh and an outer fine-screen steel mesh. Interposed between the coarse-screen mesh and the fine-screen mesh are layers of steel wool and preferably non-biopersistent (non-carcinogenic) ceramic "paper" material. In this embodiment, the steel wool is a fine #000 steel wool, with a 35 micron fiber size. Preferably, the steel wool is an extra fine #0000 fiber size.

In this embodiment the ceramic material is the UNIFRAX 1-2 micron fibre PC204 material, with a composition of 52% $SiO_2$, 46% $Al_2O_3$, and 2% other material. Alternatives such as the UNIFRAX 2-4 micron fibre PC440 material may be used. The above-noted UNIFRAX materials are known as "Category 2" materials in the European Union's "FIBER DIRECTIVE", otherwise known as Directive 97/69/EC. The inventors are also investigating the viability for use as alternatives of the following "Category 3" materials: an INSULFRAX 3.2 micron fibre, 64% $SiO_2$, 30% CaO, 5% MgO, 1% $Al_2O_3$ material, an ISOFRAX 4 micron fibre, 75% $SiO_2$, 23% MgO, 2% Other material, and a FIBROX 5.5 micron fibre, 47% $SiO_2$, 23% CaO, 9% MgO, 14% $Al_2O_3$, 7% Other material. Thermal Ceramics Incorporated of Augusta, Ga., U.S.A. provides ceramic materials also that are being investigated for viability.

During manufacture, the outer fine screen mesh and the steel wool and ceramic layers are rolled together and formed into a cylinder around the coarse mesh screen to form the cylindrical filter pad 1030. If the steel wool and/or mesh screens being employed hold machine oil, then the filter pad 1030 is baked to burn off any machine oil attached thereto at this point. The burning off of the machine oil prior to use of the generator ensures that the machine oil does not get discharged along with the fire suppressing gas during use. It will be understood that, alternatively the steel wool and meshes could be baked prior to assembly.

The filter pad 1030 functions to inhibit escape of particulates from the interior of the generator 1000 when the grains 1022, 1024 are ignited, and also to absorb some of the heat generated upon ignition of the grains 1022, 1024.

More particularly, the ceramic fibers are considered the main filtration element, with the steel wool on the inner layers being the course filter element. The steel wool also advantageously inhibits or stops the tunneling that can occur otherwise if the ceramic material is locally attacked by sodium oxide ($Na_2O$). The sodium oxide tends to cause the ceramic material to reach a lower melting point and as a result form holes in the filter. As such, when the sodium oxide hits the steel wool the local attack is blunted and spread out so that when it reaches the next ceramic layer is has a broad front. The outer fine steel mesh layer serves as a mechanical support, whereas the inner coarse mesh tube defines the inner diameter of the filter pad 1030.

Directly against the inner surface of the housing 1012 is a hermetic sealing layer (not shown) for preventing or significantly inhibiting ambient moisture from entering the housing 1012 through the discharge ports and being absorbed in the solid propellant grains. As shown in the figures, the discharge ports 1014 have a "figure eight" shape formed by drilling/punching two proximate and connected holes through the housing 1012. This shape of discharge port 1014 advantageously provides two sharp points at the midpoint of the discharge port 1014 against which the hermetic sealing layer is generally forced upon its expansion upon ignition due to internal pressure buildup. While preferably the hermetic sealing layer would be of such a material that would be ripped due to internal pressure alone, the sharp points provide increased chance of piercing of the hermetic sealing due to the increased internal pressure to allow the fire suppressing gas to escape. It will be understood that other shapes of holes could be provided that encourage piercing of the hermetic sealing layer in this manner.

Directly inside the hermetic sealing layer surrounding the filter pad is a plenum space formed by a spacer, which in this embodiment is 1/16 inch wire 1032 that is wrapped around the filter pad 1030. The wire 1032 functions to provide the plenum space between the filter pad 1030 and the interior wall of the housing 1012 so that fire suppressing gas, generated upon ignition first at the ends of the housing 1012 and then progressively inwards from the ends, can exit from numerous additional discharge ports 1014 and not only those that are located directly adjacent the burning propellant grains 1022, 1024. Thus, internal pressure built up during ignition can be distributed through the plenum space assured by the wire 1032 across the set of discharge ports 1014, which serves to limit the buildup of internal pressure during use. The wire 1032 also beneficially functions to maintain the filter pad 1030 in a cylindrical shape for insertion of the propellant grains 1022, 1024 therein particularly during manufacture of the generator 1000. The wire 1032 also absorbs some of the heat generated upon ignition of the grains 1022, 1024.

Figure 22:
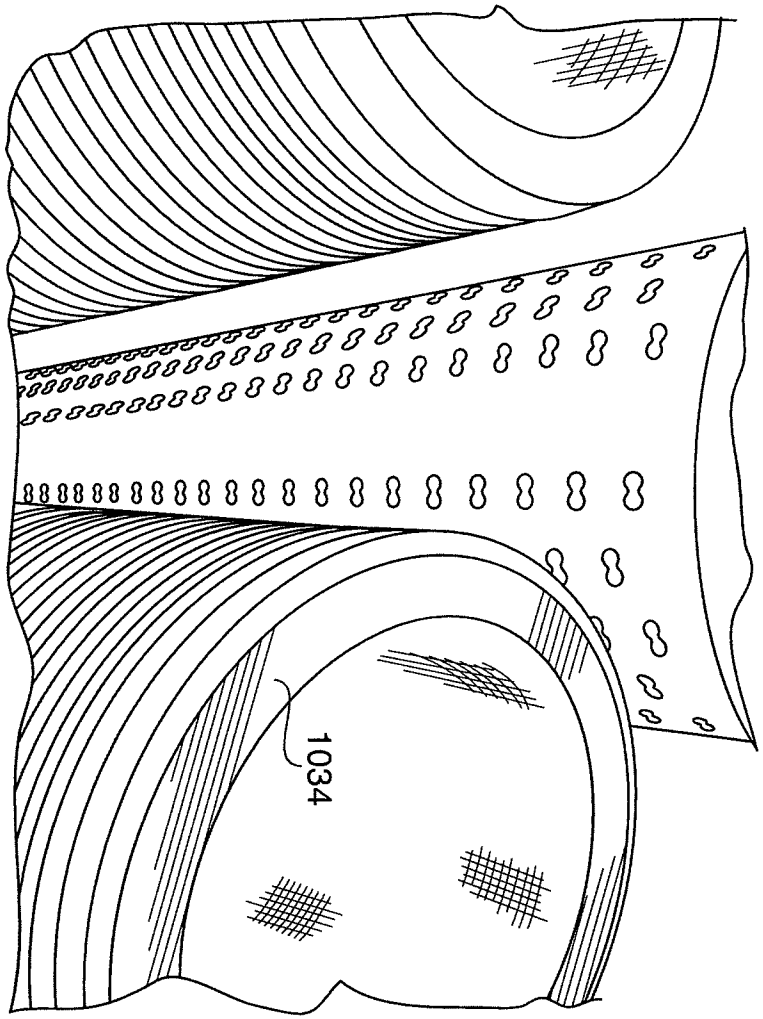
Figure 23:
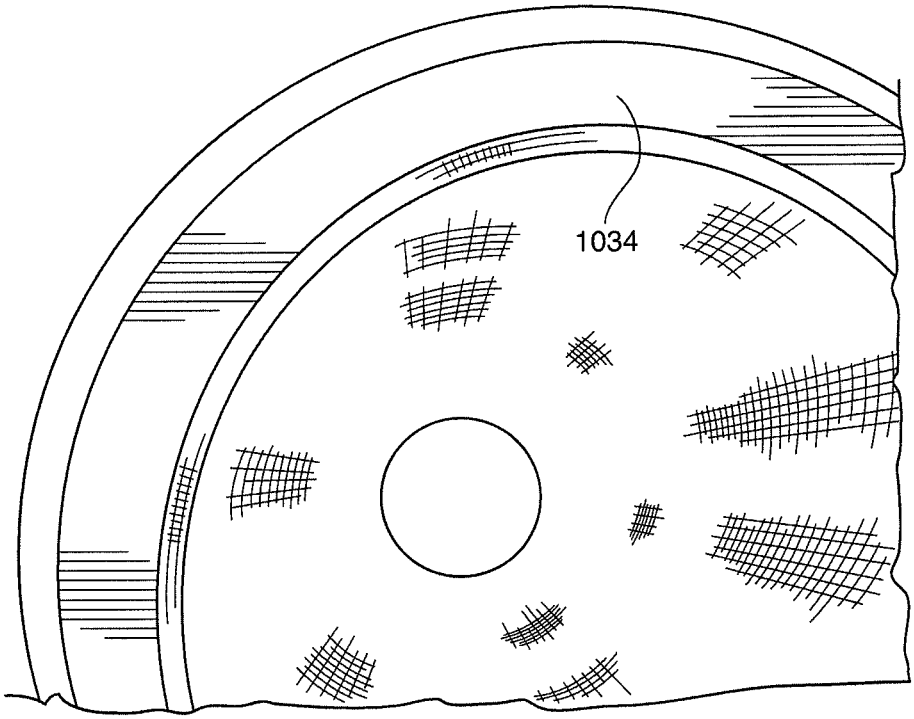
Figure 28:
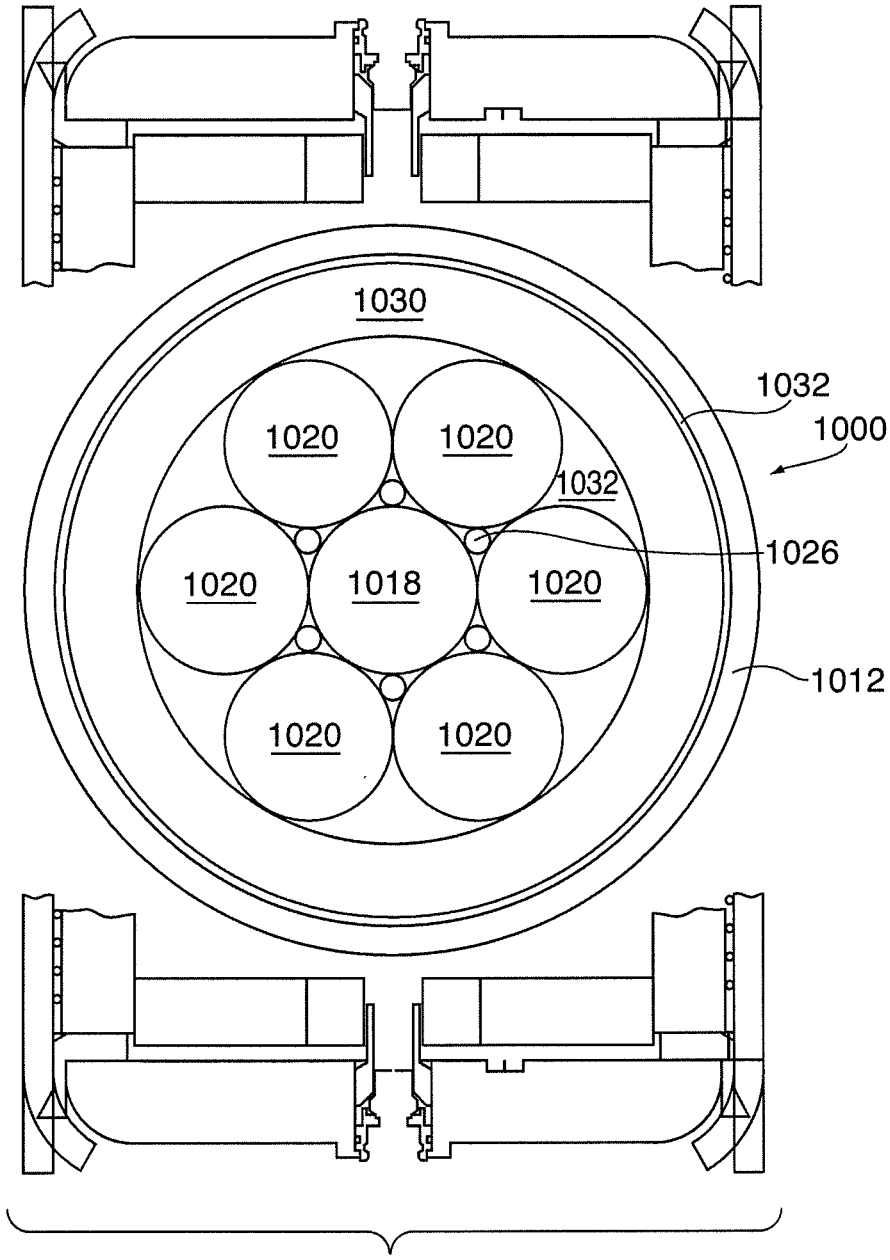
FIG. 28 shows a partial view of an alternative generator housing with end cap, and an end view of a generator with the end cap removed.

A silicone sealing gasket 1034 (see also FIG. 22) is positioned at each end of the housing 1012 over each end of the cylindrical filter pad 1030. Also at each end of the housing 1012, an end ring 1036 extends past the ends of the housing 1012 and has interior-facing threads for threading with a similarly-threaded end cap 1038. With the sealing gasket in place, the end cap 1038 is threaded with the ring 1036 against the sealing gasket 1034 to seal the end of the housing 1012. In an alternative embodiment (see for example FIG. 25) there is no end ring 1036, and the housing itself is machined with female threads for threading with a male-threaded end cap. Preferably, particularly in order to meet transportation safety and security regulations, the end caps are adapted to be crimped or otherwise relatively permanently secured onto the end of an adapted housing 1012 so that the end caps cannot be removed. One such configuration is shown in FIG. 28, including a housing with ends that are adapted to be bent or crimped over top of the end cap, and thereby permanently pressing it into place onto the gasket.

Each end cap 1038 has a central bore 1040 therethrough for receiving a squib barrel in a strong snap- or threaded fit. The squib barrel extends through the end cap 1038 and extends at least partially into the central bore of the end propellant grain 1024. The sealing gasket 1036 held in place by the end cap 1038 functions to substantially prevent the exit of generated fire suppressing gas through the ends of the filter pad 1030 and out of the housing 1012. This ensures that the generated fire suppressing gas escapes through the discharge ports 1014 of the housing 1012 via the filter pad 1030.

Figure 14:
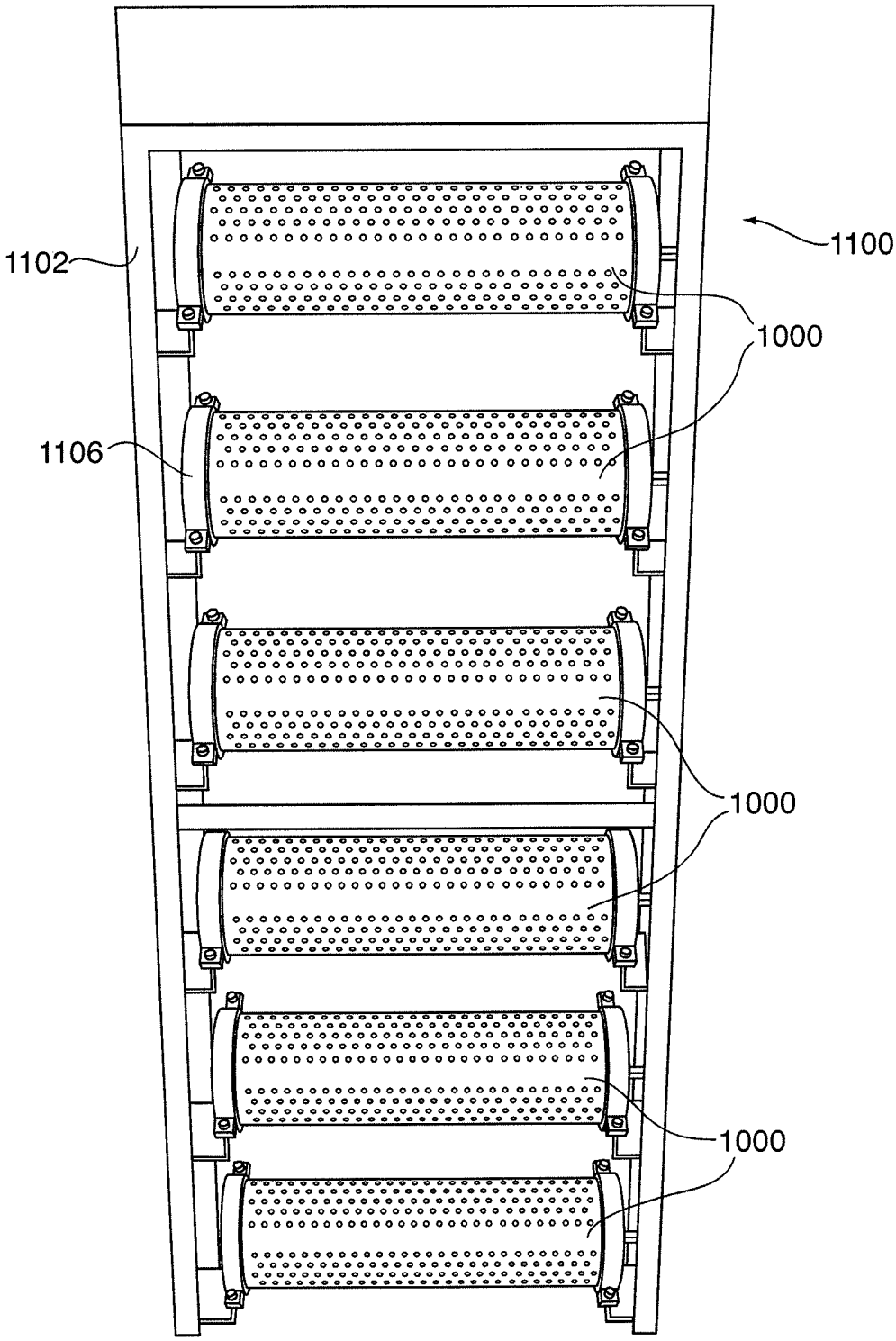
FIG. 14 shows a tower that houses multiple fire suppressing gas generators.
Figure 15:
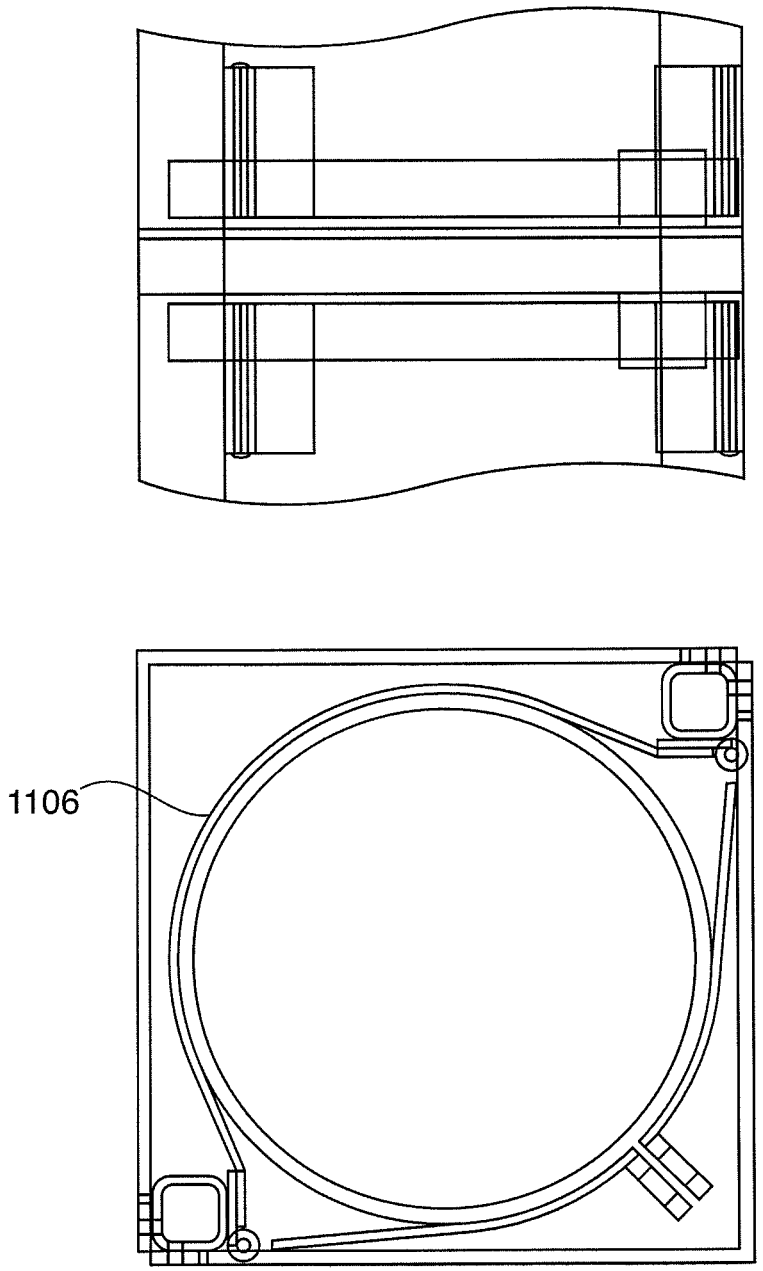
FIG. 15 is an end view of a portion of one embodiment of a bracket holding a fire suppressing gas generator within the tower of FIG. 14.

FIG. 14 shows a tower 1100 that houses multiple fire suppressing gas generators 1000. Tower 1100 comprises a generally rectangular steel tower frame 1102 comprising four interconnected vertical frame members 1103 and several slats 1104 that each support a generator bracket 1106. Each generator 1000 is disposed horizontally and is held tightly to frame 1102 by two (2) generator brackets 1106. FIG. 15 is an end view of a portion of one embodiment of a bracket 1106 holding a generator 1000. In FIG. 15 it can be seen that upon tightening of bracket fasteners (not shown) the bracket grips generator 1000 increasingly tightly.

Figure 16:
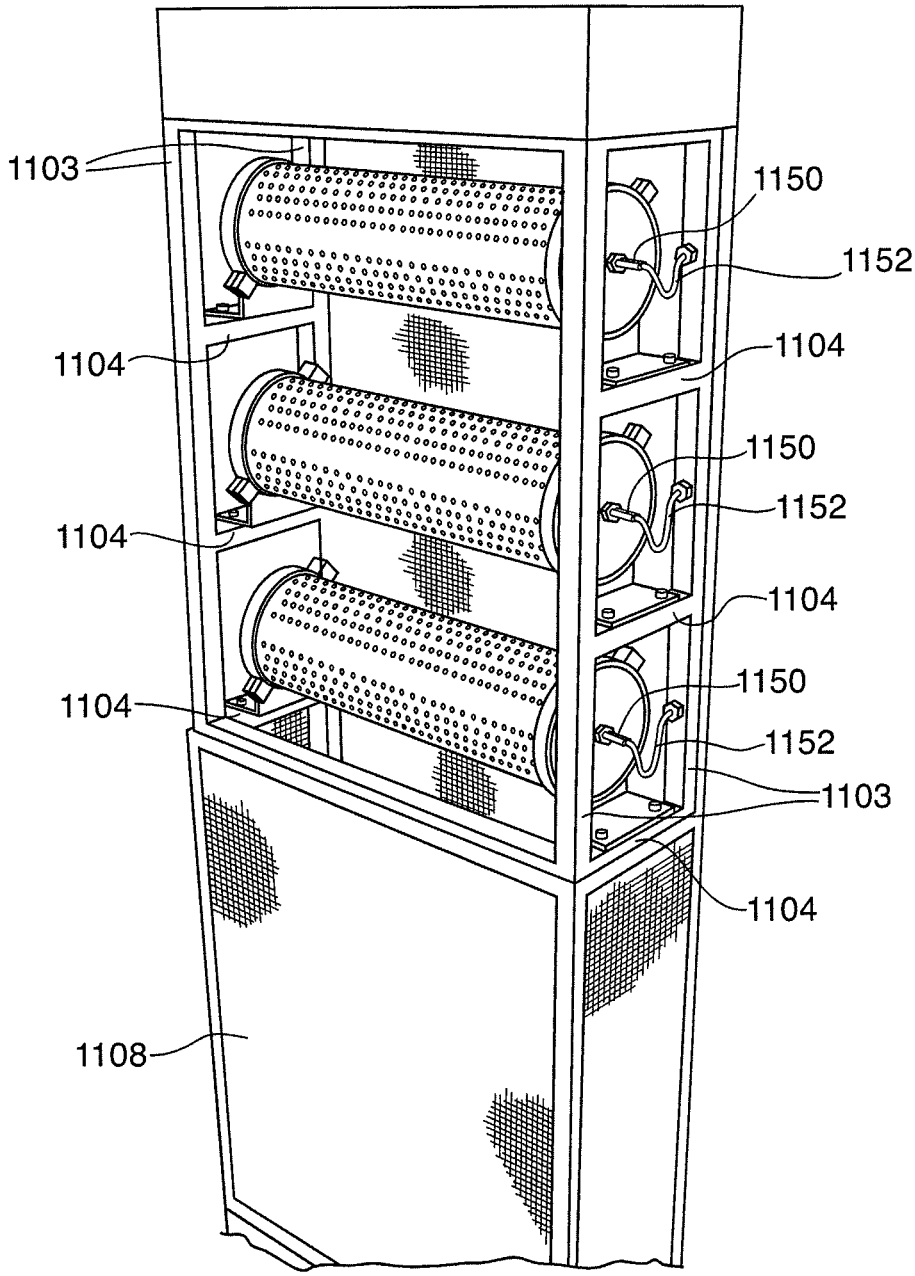
FIG. 16 shows a corner view of the tower of FIG. 14 with a lower perforated steel panel.
Figure 17:
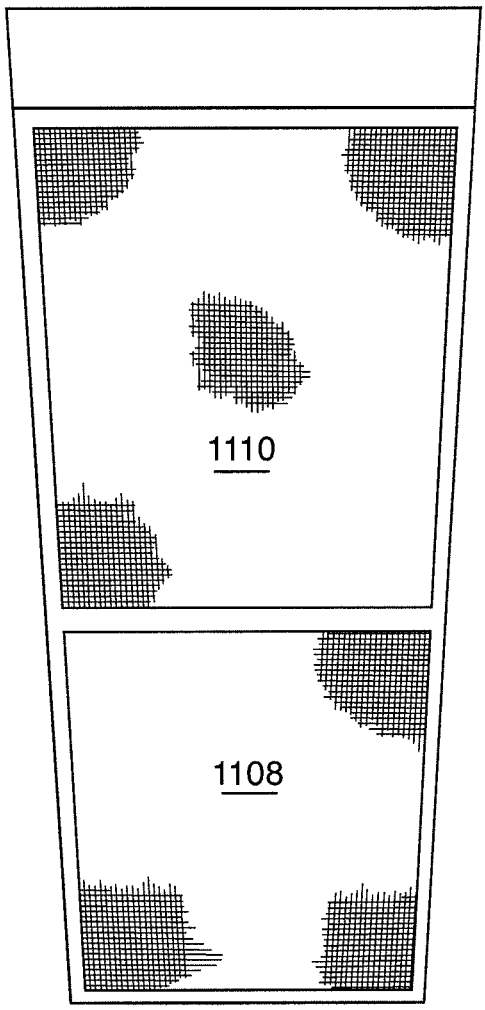
FIG. 17 shows a frontal view of the tower of FIG. 14 with both lower and upper perforated steel panels.

FIG. 16 shows a corner view of the tower 1100, in which squibs 1150 can be seen inserted into bores 1040 through end caps 1038. Lead wires 1152 extend from squibs 1150 and pass into the interior of a vertical frame member 1103 and to an ignition controller (not shown). In response to detection of a fire, the ignition controller is capable of igniting all of the generators 1000 in tower 1100 at once, or in a timed sequence. Also shown in FIG. 16 is a lower perforated steel panel 1108 that is removably affixed to the frame 1102 with fasteners. FIG. 17 shows both the lower perforated steel panel 1108 and an upper perforated steel panel 1110 removably affixed to the frame 1102 with fasteners. The steel panel is perforated to enable fire suppressing gas generated by the generators 1000 held within the tower 1100 to escape into a space for suppressing a fire. In order to ensure that a space, such as a computer room, would be adequately flooded with fire suppressing gas, multiple towers 1100 each having multiple generators may be placed in the space.

Figure 18:
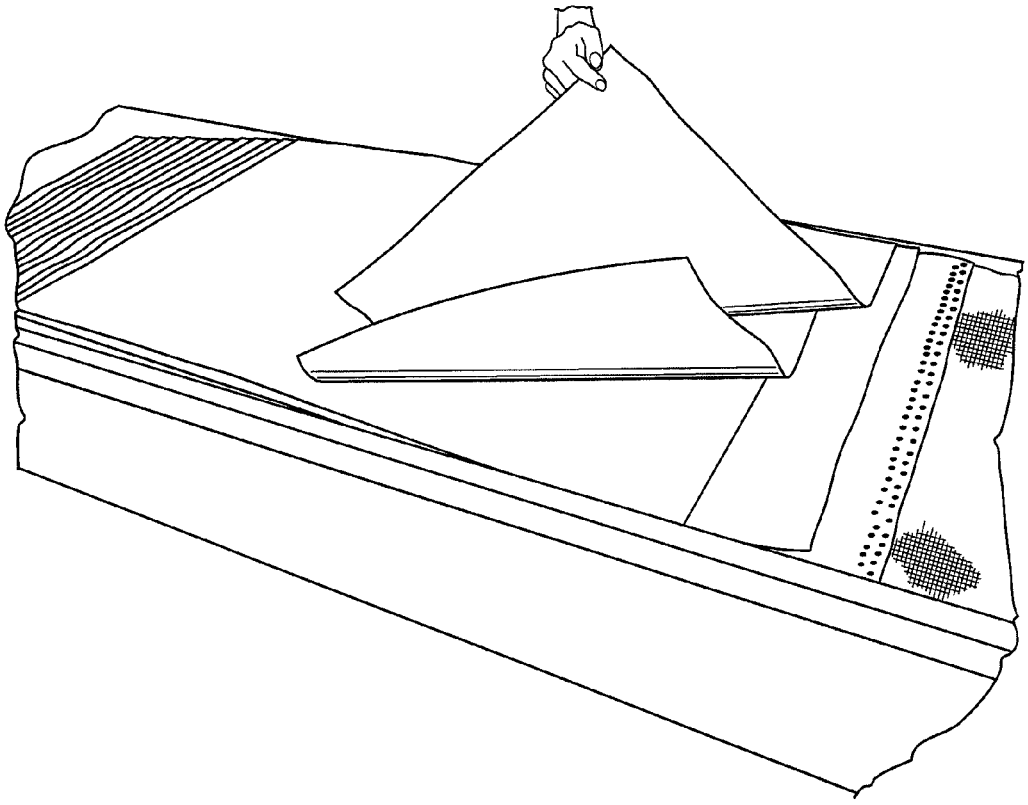
FIGS. 18 and 19 show various layers of the filter pad of the fire suppressing gas generator.
Figure 19:
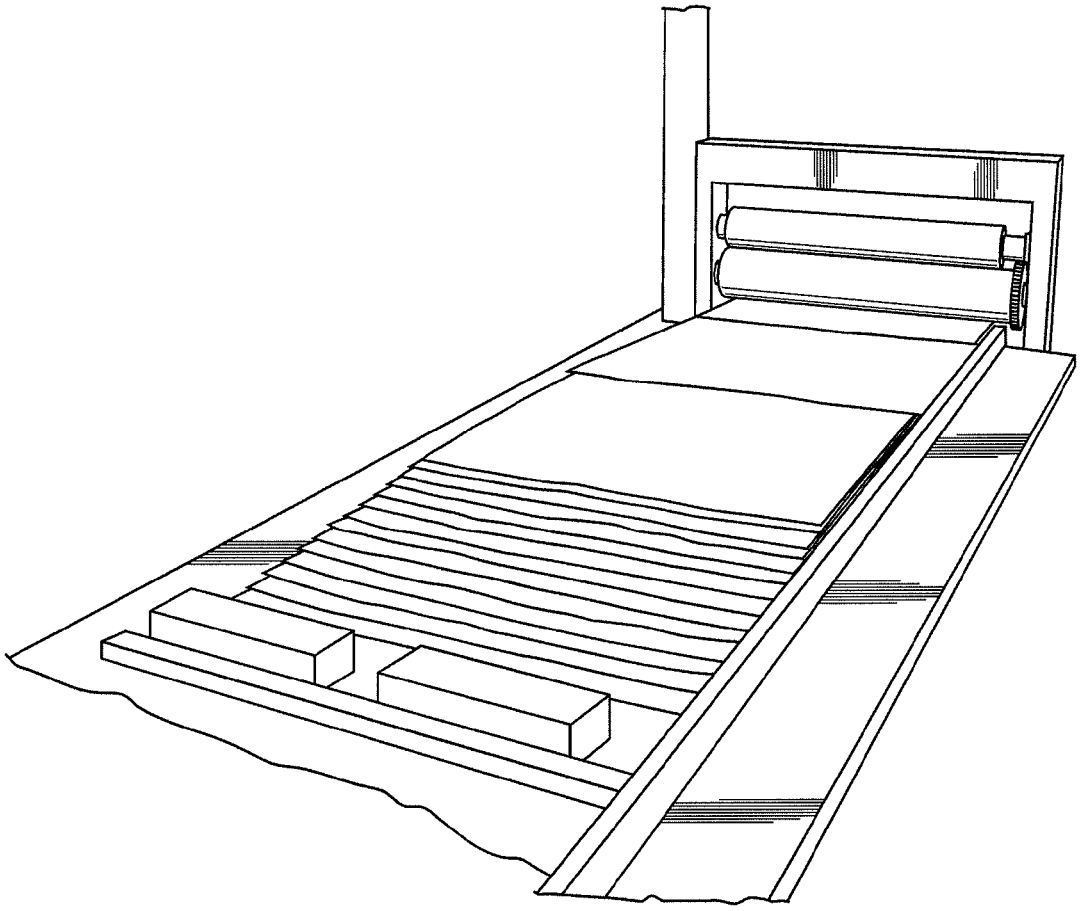
Figure 20:
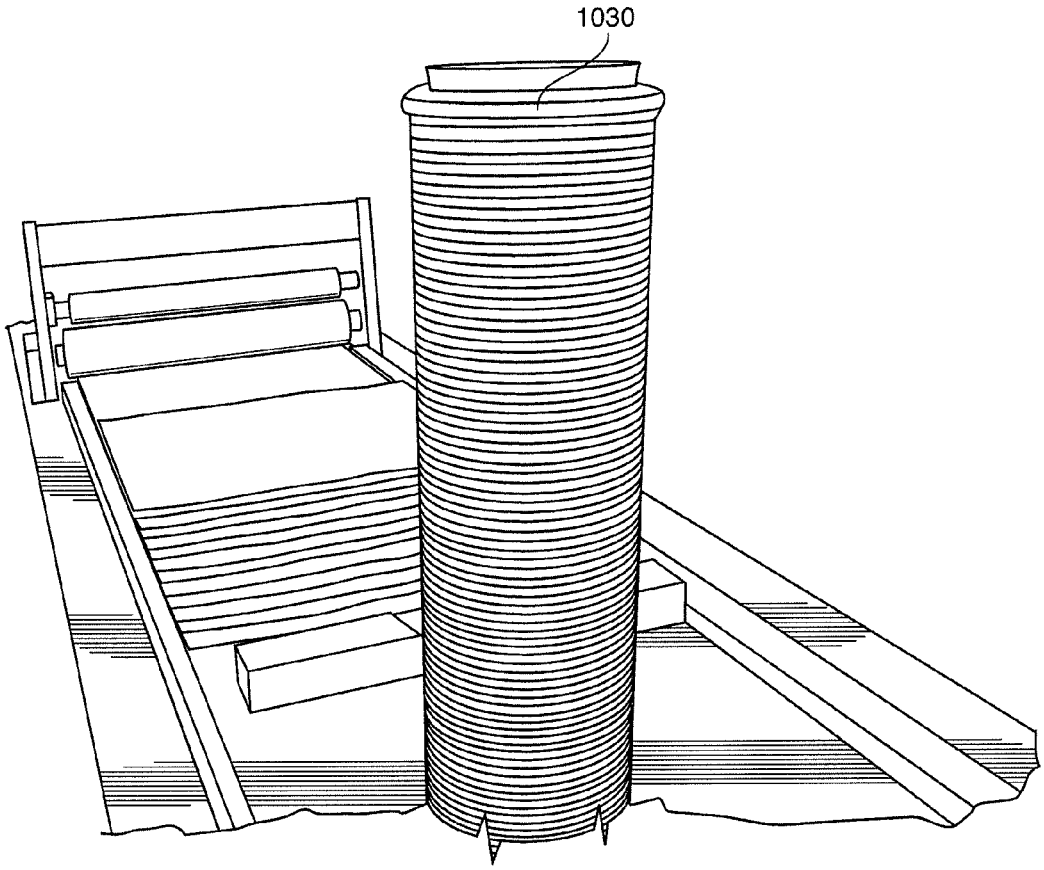
FIGS. 20 to 23 show various views of the filter pad maintained in a cylinder shape by a plenum space wire.
Figure 21:
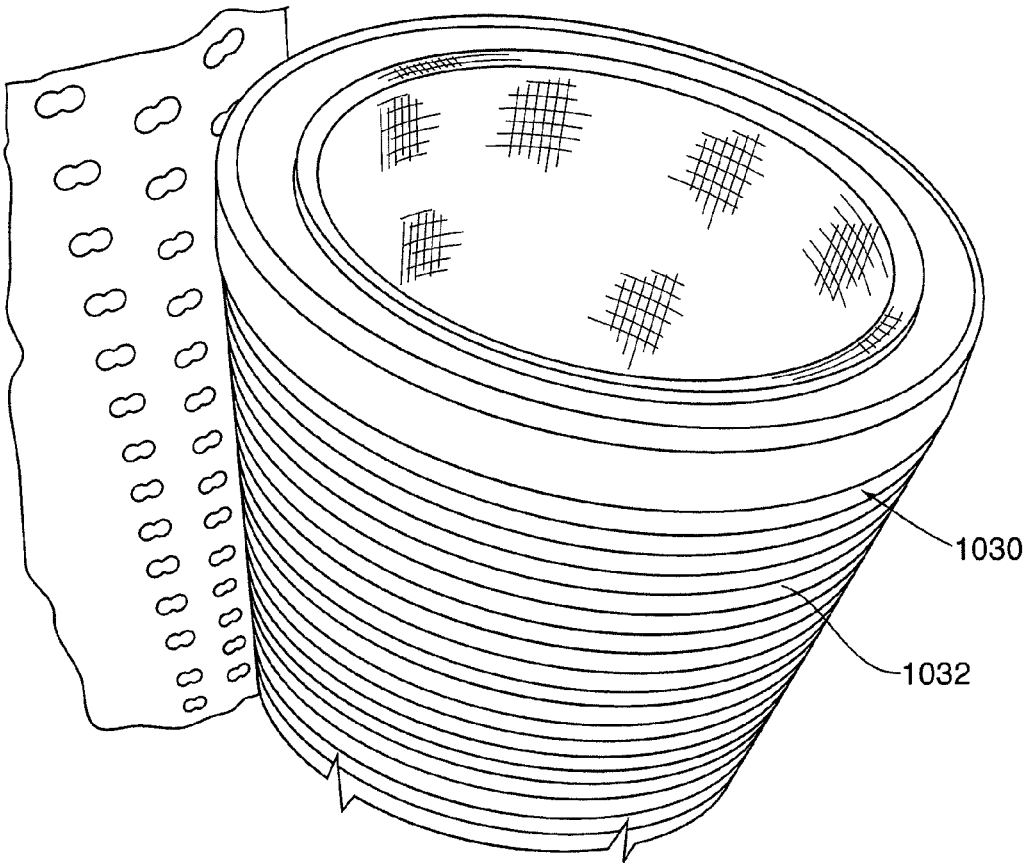

FIGS. 18 and 19 show the various layers of the filter pad 1030, including the fine-mesh steel wool, ceramic material, and coarse-mesh steel wool, during manufacture of the filter pad 1030.

FIGS. 20 to 23 shows various views of the filter pad, 1030 maintained in a cylinder shape by plenum space wire 1032.

Figure 24:
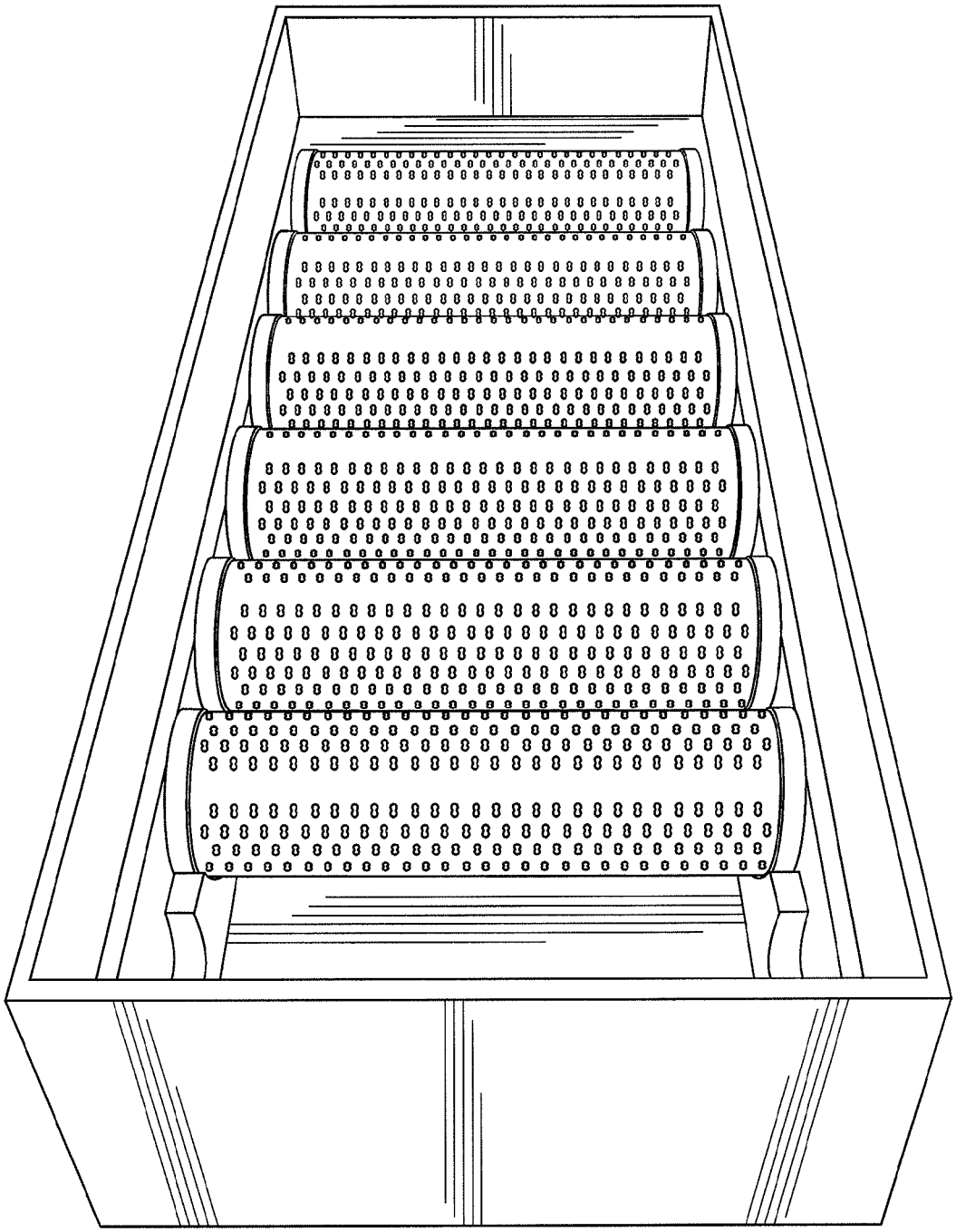
FIG. 24 shows several fire suppressing gas generators in a box for transportation.

FIG. 24 shows several generators 1000 in a box for transportation. Advantageously, because of the 360 degree generally uniform distribution of discharge ports 1014, and the advantages accorded by the wire plenum 1032, generators 1000 are substantially "thrust neutral." More particularly, if during transportation or storage the propellant grains 1022, 1024 inside the generator 1000 were to accidentally ignite, the generator would not be propelled dangerously as though it were a rocket. Many prior art fire suppression devices, such as compressed gas cylinders, that do not discharge fire suppression gas uniformly as does generator 1000 have accordingly increased handling risk and expense associated with them. In fact, federal transportation laws in some jurisdictions severely limit the conditions under which such thrust non-neutral devices may be transported and/or stored.

Figure 25:
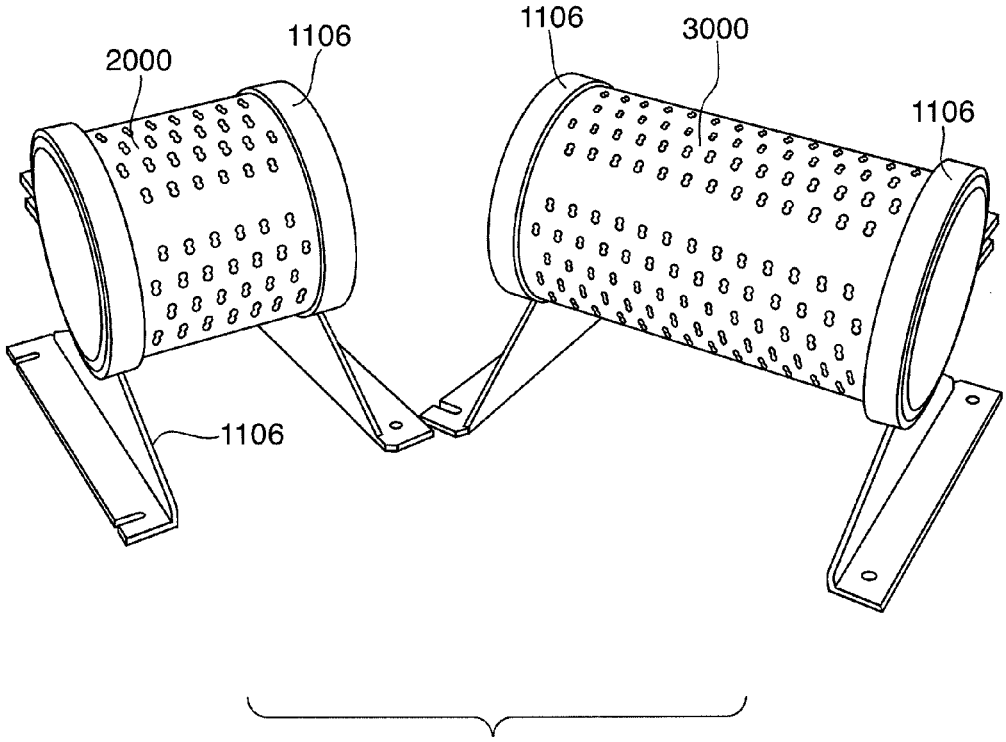
FIG. 25 shows two alternative generators.

FIG. 25 shows two alternative generators 2000 and 3000 in respective brackets 1106. Generators 2000 and 3000 are substantially the same as generator 1000 described above, but are smaller in length and therefore carry less propellant grain. Such generators 2000, 3000 may be provided for smaller rooms or may be provided along with larger generators.

In certain situations, it is useful to direct the fire suppressing gas exiting a generator 1000 in a particular direction, rather than in 360 degrees. For example, in armored vehicle applications, where occupant safety is of primary concern, directing the fire suppressing gas away from the occupants is advantageous.

A surprising advantage to redirecting fire suppressing gas away from occupants was discovered when, during testing, the fire suppressing gas from two generators 1000 was redirected generally along the wall of the test enclosure using an auxiliary diffuser sleeve placed during installation over a housing 1012 of a generator 1000. During the test, two generators 1000 were bracketed at opposite corners of a 260 cubic foot, rectangular steel test box. Auxiliary diffuser sleeves similar to those shown in FIG. 25 were slid over the entire length of the housing 1012 and affixed to respective generators 1000. The discharge ports were directed somewhat tangentially at an approximately 15 degree angle to the walls adjacent the corners at which the generators 1000 were bracketed, so as to ensure that fire suppressing gas was discharged in opposite directions. Advantageously this configuration created a cyclone effect within the test box upon discharge by the generators. This cyclone discharge removed the flame of an explosive fire ball from the fuel 25% quicker than did larger generators with undirected discharge. The fire was thereby initially extinguished before the concentration of oxygen dropped to 14.4% in the space. The oxygen concentration having dropped as required then completed the extinguishing process by preventing the flame from reigniting.

Without citing any particular theory, it is believed that the advantageous extinguishing of the flame as described above was due to the tendency of the elements in the fire extinguishing gas to spin. The increased spinning, or increased "vorticity", was assisted by the tendency of the elements adjacent to the walls to cling to the walls, an effect related in principle to the Coanda effect. The present inventors are not aware of any prior art fire suppression systems that purposely discharge fire suppression gas along an object in the room such as a wall of the room or a wall in the room, or other object so as to create a cyclone effect as described above to increase its fire suppressing effectiveness. Preferably, to produce this effect the fire suppressing gas is discharged so as to provide the largest possible circulation pattern unbroken by intervening objects. Thus, in one embodiment the fire suppressing gas would be discharged from a corner of a room along the longest wall of the room.

Figure 26:
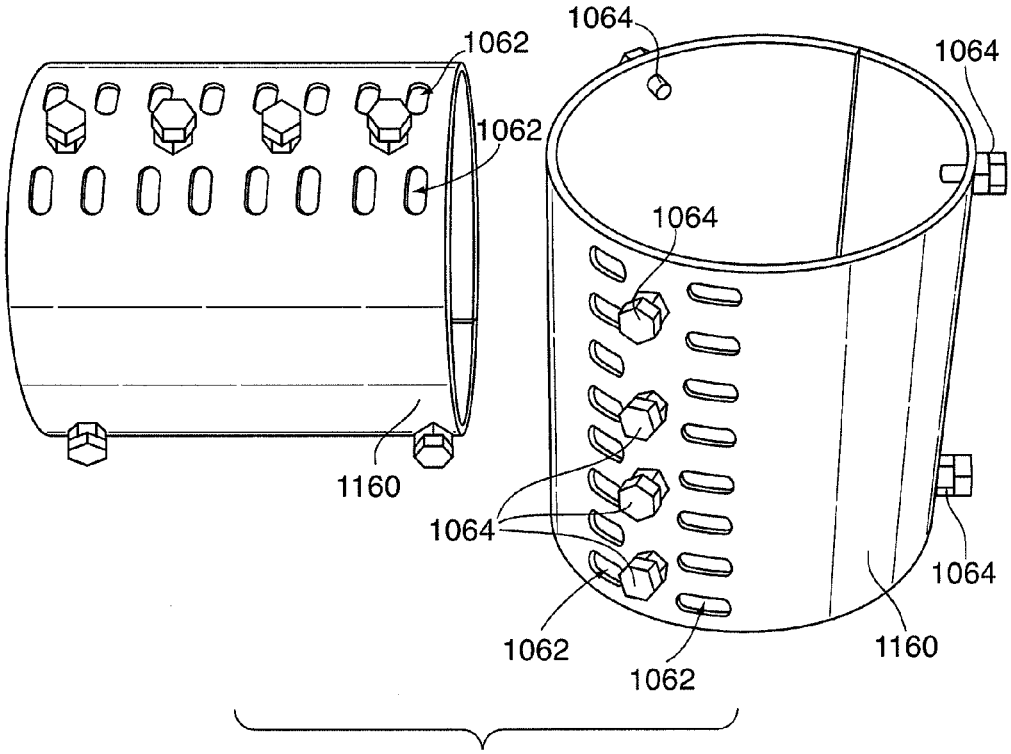
FIG. 26 shows two auxiliary diffusers.
Figure 27:
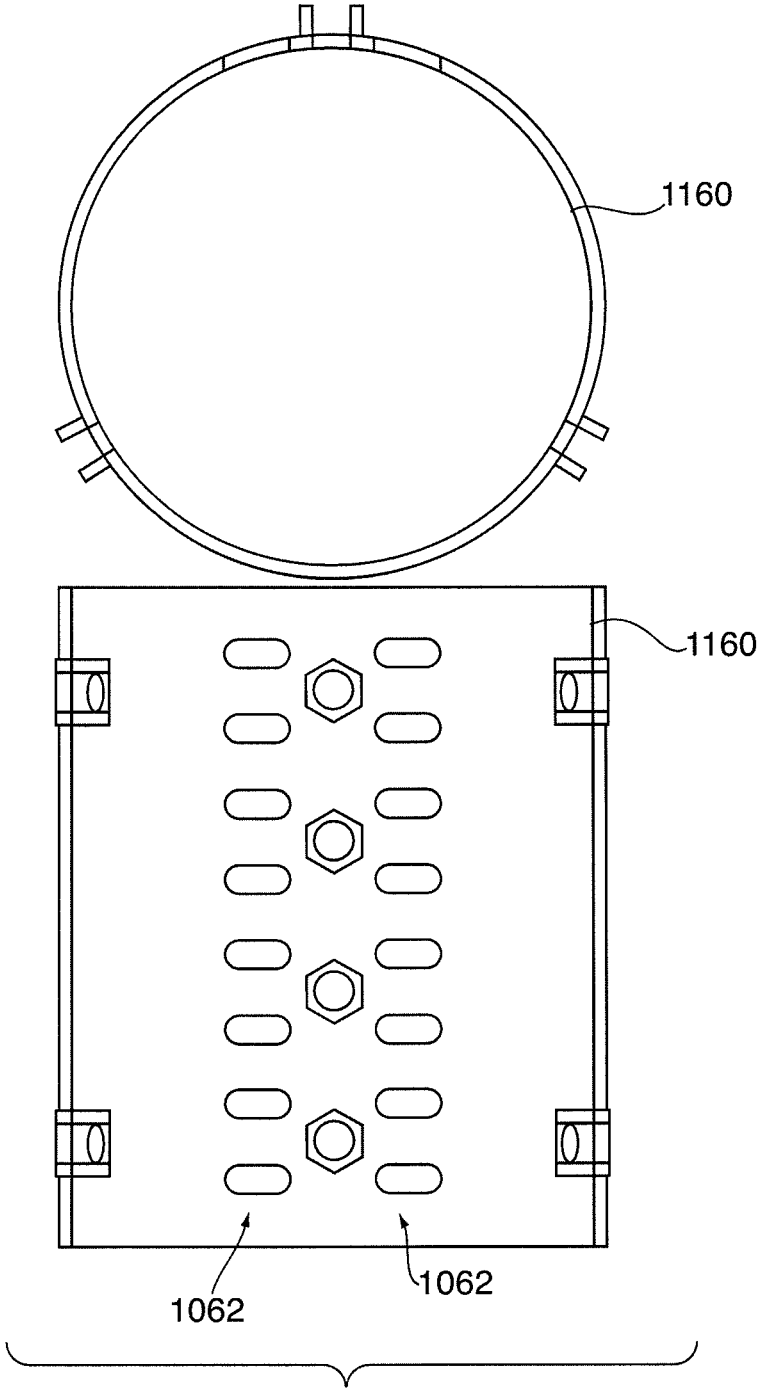
FIG. 27 shows top and side views of an auxiliary diffuser.

FIGS. 26 and 27 show steel auxiliary diffuser sleeves 1160 each comprising two lines of auxiliary discharge ports 1062 and clamping bolts 1064. In this embodiment, each auxiliary diffuser sleeve 1160 is sized to slide over a generator 1000 and through tightening of the clamping bolts 1064 to grip the exterior surface of housing 1012. The clamping bolts 1064 in the vicinity of the two lines of auxiliary discharge ports 1062 also function to ensure that, in this low pressure region, the diffuser sleeve 1160 does not fall against the housing 1012 causing blocking of discharge ports. The diffuser sleeve 1160 functions to ultimately limit discharge of fire suppressing gas so as to direct discharge in a particular direction, and to absorb heat from the generated fire suppressing gas. A hemispherical silicone foam gasket is preferably disposed between the exterior surface of the housing 1012 and the diffuser sleeve 1160 to inhibit the transfer of absorbed heat from the diffuser sleeve 1160 to the housing 12, and vice-versa. In embodiments, a diffuser sleeve may be formed of a sheet of metal that is rolled over the housing 1012 and spaced from the housing 1012 with support bumps on the housing 1012 and/or on the sleeve itself, rather than or in combination with clamping bolts 1064 or other suitable structure.

While the above embodiments have been described in detail, alternatives that fall within the scope and purpose of the present invention are possible. For example, while seven columns of stacked propellant grains are shown in FIG. 13, one alternative configuration may comprise fewer and even a single column of stacked propellant grains. The propellant grains in an alternative configuration such as this may be donut-shaped, torus-shaped, or ring-shaped. Furthermore, end grains in addition to main grains may or may not be employed.

One configuration being contemplated is a column of stacked propellant grains that are cylinder-shaped and have a 4.5 inch outer diameter and a 0.5 inch inner diameter, with a fast burning booster column similar to that known in the field of automotive technology positioned within the shaft that is formed by 0.5 inch inner diameter of grains in the stack. Different thicknesses of grain may be contemplated for different applications. For example, a 4.5 inch/0.5 inch cylinder shaped grain such as that described above being 0.125 inches thick would burn in approximately 0.2 seconds, whereas a thicker grain could be used for slower burns. For fire suppression applications, it is often desirable to provide high initial flow of fire suppressing gas to first remove the flame from the fuel before shortly thereafter reaching a low enough oxygen concentration level to inert the space preventing re-ignition.

Furthermore, in alternative embodiments, propellant grains could be provided having different sizes and/or formulations within the same generator 1000 or in different generators in a particular tower 1100. The provision of propellant grains of different sizes would enable different profiles of fire suppression. For example, in order to rapidly produce fire suppressing gas for a cyclone effect to suppress an explosive fire ball but to in combination provide prolonged discharge of the fire suppressing gas to ensure the oxygen content of the room is kept sufficiently low for a period of time to inhibit re-ignition of flames.

Furthermore in alternative embodiments the filter pad could comprise layers of either course-mesh or fine-mesh steel wool.

The cylindrical generator structure described above provides a generally uniform discharge of fire suppressing gas in 360 degrees from the columns of stacked cylindrical propellant grains. This provides advantages that relate to thrust neutrality and also to the uniform discharge in a space for total flood applications. The multiple discharge ports distributed generally uniformly across the housing both over generally 360 degrees but also along the housing so as to correspond to grain positioning within the housing also enables gas generated by grains at each physical location within the housing to quickly makes its own escape into a space. This causes only little backpressure when compared with prior systems that do not provide multiple discharge ports distributed generally uniformly across the housing as described and shown herein.

The grains are stacked in 6 columns adjacent to the central column in order to ensure that the cylindrical grains maintain contact with each other, thereby to increase the opportunity for faster and efficient burning throughout.

It is contemplated that a housing that is generally rectangular, square or elliptical in cross-section could be employed, having discharge ports distributed generally uniformly across and along all sides in a similar manner to the cylindrical structure. While a wire plenum as a spacer has been described that has the additional advantage of structurally holding the cylindrical filter pad together, other spacers may be contemplated. For example, alternatively or in some combination studs or rings or other structures around the filter pad or protruding from the inner wall of the housing could be provided. Such structures could also serve to carry out the spacer's function of providing a plenum for inhibiting buildup of undue backpressure by enabling generated gas to exit from numerous discharge ports and not only those that are located directly adjacent the particular burning propellant grains that are generating the escaping gas.

Although preferably the propellant grains are of a sodium azide solid propellant chemical, the generator structure described herein could house and ignite non-azide solid propellant chemical also, though in order to control the heat of gases discharged modifications to the heat sinking would likely be required, accordingly increasing the size of the generator.

There are thus described novel structures and features to provide fire suppression systems for occupied spaces employing azide based propellant gas generators, which meet all of the objectives set forth herein and which overcome the disadvantages of existing techniques.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

Although embodiments have been described, those skilled in the art will appreciate that variations and modifications may be made without departing from the spirit and scope of the invention defined by the appended claims.

What is claimed is:

1. A fire suppressing gas generator comprising:

a cylindrical housing comprising an array of discharge ports distributed thereon;

a cylindrical filter disposed within the housing and spaced from an interior wall of the housing;

a plurality of azide-based propellant grains inside the cylindrical filter, the plurality of azide-based propellant ant rains comprising at least one column of stacked propellant grains; and at least one ignition device associated with the propellant grains wherein the at least one column comprises an end grain at each end thereof that includes a central bore dimensioned to receive at least a portion of the ignition device therein;

wherein the propellant grains when ignited by the ignition device generate a fire suppressing gas which passes through the filter and out of the discharge ports of the cylindrical housing for delivery into a space, and wherein the distribution of the discharge ports on the housing provides substantially thrust neutrality to the generator when the fire suppressing gas passes out of the discharge ports.

2. The fire suppressing gas generator of claim 1, wherein the cylindrical filter is spaced from the interior wall of the housing with a plenum wire wrapped around the cylindrical filter.

3. The fire suppressing gas generator of claim 1, wherein the cylindrical filter comprises a layer of fine-mesh screen and a layer of coarse-mesh screen.

4. The fire suppressing gas generator of claim 3, wherein the cylindrical filter further comprises layers of steel wool and ceramic material.

5. The fire suppressing gas generator of claim 3, wherein the cylindrical filter further comprises a layer of ceramic material.

6. The fire suppressing gas generator of claim 1, wherein the plurality of azide-based propellant grains comprises a plurality of columns of stacked propellant grains.

7. The fire suppressing gas generator of claim 6, wherein the propellant grains each have a shape selected from the group consisting of donut-shaped, torus-shaped and ring-shaped.

8. The fire suppressing gas generator of claim 6, wherein the stacked propellant grains are each cylindrical.

9. The fire suppressing gas generator of claim 6, wherein the plurality of columns comprises a central column and a plurality of generally parallel columns therearound.

10. The fire suppressing gas generator of claim 1, wherein the plurality of azide-based propellant grains comprises a single column of stacked propellant grains.

11. The fire suppressing gas generator of claim 1, further comprising an auxiliary diffuser sleeve dimensioned to receive the generator, the auxiliary diffuser sleeve comprising at least one line of auxiliary discharge ports for directing generated gas in a particular direction.

12. The fire suppressing gas generator of claim 1, comprising end caps fastened to respective ends of the housing.

13. The fire suppressing gas generator of claim 12, further comprising gaskets between the cylindrical filter and end caps.

14. The fire suppressing gas generator of claim 1, wherein the distribution of the discharge ports is on opposite sides of the housing.

15. The fire suppressing gas generator of claim 1, wherein the discharge ports are distributed generally uniformly around the housing.

16. A fire suppressing system comprising:

a tower comprising a frame;

at least one fire suppressing gas generator disposed within the frame, the at least one fire suppressing gas generator comprising:

a cylindrical housing comprising an array of discharge ports distributed thereon;

a cylindrical filter disposed within the housing and spaced from the interior wall of the housing;

a plurality of azide-based propellant grains inside the cylindrical filter, the plurality of azide-based propellant grains comprising at least one column of stacked propellant grains; and at least one ignition device associated with the propellant grains wherein the at least one column comprises an end grain at each end thereof that includes a central bore dimensioned to receive at least a portion of the ignition device therein;

wherein the fire suppression system further comprises:

an ignition controller electrically connected to the at least one ignition device for causing ignition thereof, wherein the propellant grains when ignited by a respective ignition device generate a fire suppressing gas which passes through the respective filter and out of the discharge ports of the cylindrical housing for delivery into the space, and wherein the distribution of the discharge ports on the housing provides substantially thrust neutrality to the generator when the fire suppressing gas passes out of the discharge ports.

17. The fire suppressing system of claim 16, wherein the at least one fire suppressing gas generator is supported horizontally on the frame by at least two brackets each dimensioned to grip the exterior of the cylindrical housing of the at least one fire suppressing gas generator.

18. The fire suppressing system of claim 16, further comprising at least one perforated panel removably affixed to the frame for enclosing the at least one fire suppressing gas generator within the frame, wherein the fire suppressing gas passes from the interior of the tower to its exterior through the perforations in the at least one panel.

19. The fire suppressing gas generator of claim 16, wherein the distribution of the discharge ports is on opposite sides of the housing.

20. The fire suppressing gas generator of claim 16, wherein the discharge ports are distributed generally uniformly around the housing.

21. A fire suppressing gas generator comprising:

a housing comprising an array of discharge ports distributed thereon;

a filter disposed within the housing and spaced from the interior wall of the housing;

a plurality of propellant grains inside the filter, the plurality of propellant grains comprising at least one column of stacked propellant grains; and at least one ignition device associated with the propellant grains, wherein the at least one column comprises an end grain at each end thereof that includes a central bore dimensioned to receive at least a portion of the ignition device therein;

wherein the propellant grains when ignited by the ignition device generate a fire suppressing gas which passes through the filter and out of the discharge ports of the housing for delivery into a space, and wherein the distribution of the discharge ports on the housing provides substantially thrust neutrality to the generator when the fire suppressing gas passes out of the discharge ports.

22. The fire suppressing gas generator of claim 21, wherein the housing is cylindrical.

23. A fire suppressing system comprising:

a tower comprising a frame; and at least one fire suppressing gas generator as set forth in claim 21 disposed within the frame;

wherein the propellant grains when ignited by a respective ignition device generate a fire suppressing gas which passes through the respective filter and out of the discharge ports of the housing for delivery into the space.

24. The fire suppressing gas generator of claim 21, wherein the distribution of the discharge ports is on opposite sides of the housing.

25. The fire suppressing gas generator of claim 21, wherein the discharge ports are distributed generally uniformly around the housing.

* * * * *